US009739046B2

(12) United States Patent
Miskovich

(10) Patent No.: US 9,739,046 B2
(45) Date of Patent: Aug. 22, 2017

(54) MODULAR STORMWATER RETENTION AND MANAGEMENT SYSTEM

(71) Applicant: Joseph S. Miskovich, Fenton, MI (US)

(72) Inventor: Joseph S. Miskovich, Fenton, MI (US)

( * ) Notice: Subject to any disclaimer, the term of this patent is extended or adjusted under 35 U.S.C. 154(b) by 0 days.

(21) Appl. No.: 15/172,691

(22) Filed: Jun. 3, 2016

(65) Prior Publication Data

US 2016/0281347 A1 Sep. 29, 2016

Related U.S. Application Data

(63) Continuation-in-part of application No. 14/643,118, filed on Mar. 10, 2015, now Pat. No. 9,371,938.

(60) Provisional application No. 61/951,771, filed on Mar. 12, 2014.

(51) Int. Cl.

| | |
|---|---|
| ***E03F 5/10*** | (2006.01) |
| ***E02B 11/00*** | (2006.01) |
| ***E04F 15/12*** | (2006.01) |
| ***E04B 5/32*** | (2006.01) |
| ***E04B 5/36*** | (2006.01) |

(52) U.S. Cl.

CPC ..... *E03F 5/101* (2013.01); *E02B 11/005* (2013.01); *E04B 5/326* (2013.01); *E04B 5/36* (2013.01); *E04F 15/123* (2013.01); *Y10T 29/49826* (2015.01)

(58) Field of Classification Search

CPC ..... F16L 1/11; F16L 57/06; B23P 19/00

See application file for complete search history.

(56) References Cited

U.S. PATENT DOCUMENTS

| | | | |
|---|---|---|---|
| 1,529,019 | A | 3/1925 | Evans |
| 4,910,568 | A | 3/1990 | Takei et al. |
| 5,087,151 | A | 2/1992 | DiTullio |
| 5,241,979 | A | 9/1993 | Chang |
| 5,322,387 | A | 6/1994 | Heine et al. |
| 5,445,730 | A | 8/1995 | Pattee |
| 5,890,838 | A | 4/1999 | Moore, Jr. et al. |

(Continued)

FOREIGN PATENT DOCUMENTS

| | | | |
|---|---|---|---|
| EP | 0803618 | A2 | 10/1997 |
| EP | 1932975 | A1 | 6/2008 |

(Continued)

OTHER PUBLICATIONS

European Intellectual Property Office, International Search Report and Written Opinion in corresponding International Application No. PCT/US2015/019668 dated Jun. 10, 2015.

*Primary Examiner* — Tara Mayo-Pinnock

(74) *Attorney, Agent, or Firm* — Young Basile Hanlon & MacFarlane, P.C.

(57) ABSTRACT

A modular storm water retention system and method for exemplary uses collecting and temporarily retaining storm water run-off. The system includes a plurality of modular retaining units which are selectively connected together to form an interior chamber volume for collecting storm water run-off directed into the chamber volume. A plurality of modular trays are engaged with the top portions of the respective retention units to prevent relative movement of the retention units and eliminate, or substantially reduce, the need for porous material to be installed in and around the retention units greatly increasing the excavation void space usable for water collection and retention. The trays further support the backfill material and prevent passage of the backfill material into the void space below the trays.

18 Claims, 24 Drawing Sheets

(56) References Cited

U.S. PATENT DOCUMENTS

| | | | |
|---|---|---|---|
| 6,062,767 | A | 5/2000 | Kizhnerman et al. |
| 6,132,139 | A | 10/2000 | Hashimoto et al. |
| 6,379,541 | B1 | 4/2002 | Nicholas |
| 6,383,372 | B1 | 5/2002 | Houck et al. |
| 7,226,241 | B2 | 6/2007 | DiTullio |
| 7,744,756 | B2 | 6/2010 | Davis, Jr. |
| 7,806,627 | B2 | 10/2010 | DiTullio |
| 7,887,256 | B2 | 2/2011 | Miskovich |
| 8,147,688 | B2 | 4/2012 | Adams et al. |
| 2003/0070977 | A1 | 4/2003 | Anderson |
| 2004/0184884 | A1 | 9/2004 | DiTullio |
| 2004/0253054 | A1 | 12/2004 | Atchley |
| 2006/0233612 | A1 | 10/2006 | DiTullio |
| 2007/0258770 | A1 | 11/2007 | Miskovich |
| 2008/0035547 | A1 | 2/2008 | Miller |
| 2008/0181725 | A1 | 7/2008 | Miskovich |
| 2009/0180834 | A1 | 7/2009 | Hedstrom et al. |
| 2009/0261036 | A1 | 10/2009 | Lucas |
| 2010/0059430 | A1 | 3/2010 | Adams et al. |
| 2013/0008841 | A1 | 1/2013 | Miskovich |

FOREIGN PATENT DOCUMENTS

| | | | |
|---|---|---|---|
| EP | 2322733 | A1 | 5/2011 |
| NL | 1020177 | C2 | 9/2003 |
| WO | 03069074 | A1 | 8/2003 |

FIG. 9
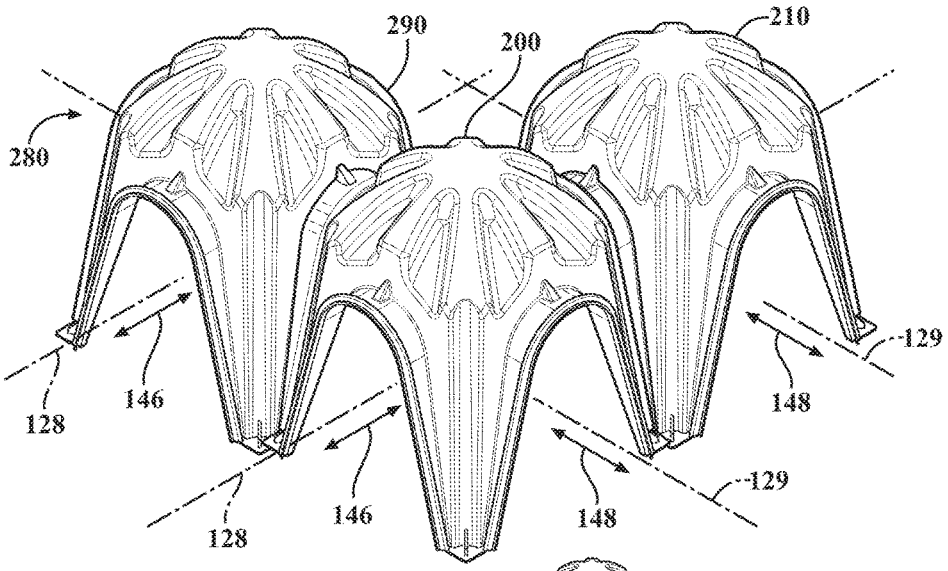
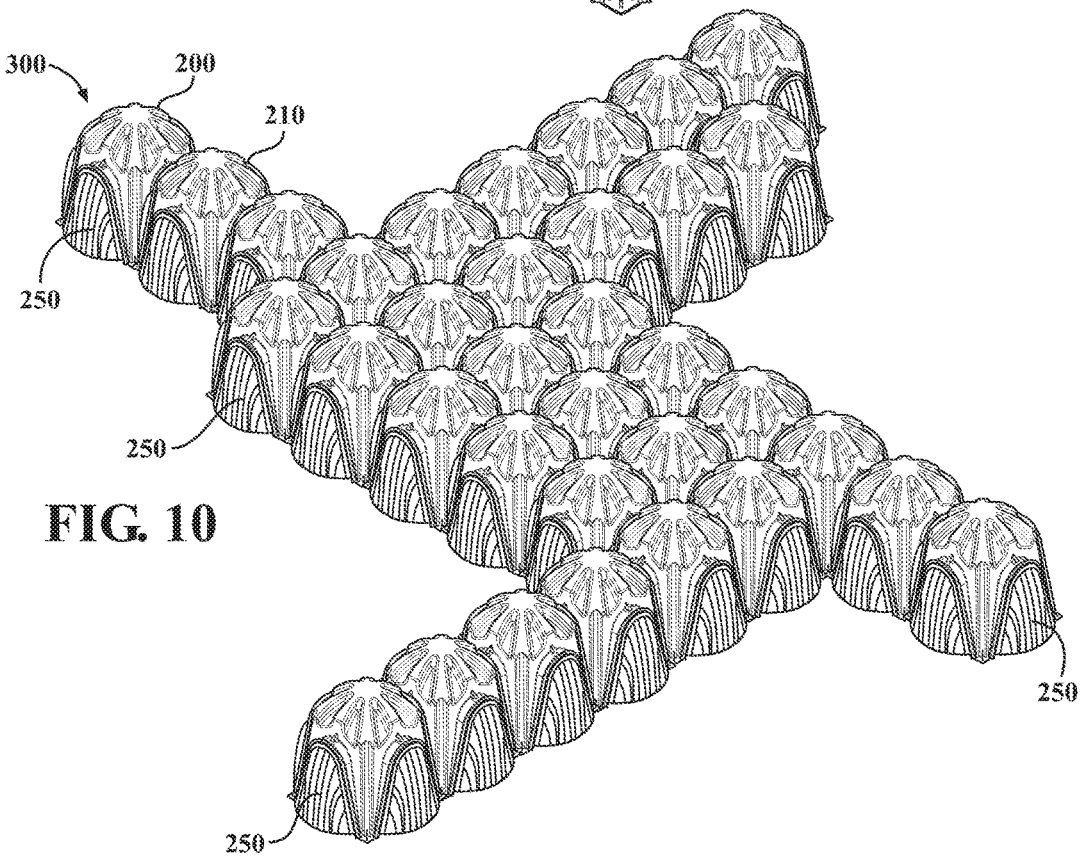
FIG. 10

MODULAR STORMWATER RETENTION AND MANAGEMENT SYSTEM

CROSS-REFERENCE TO RELATED APPLICATIONS

This continuation-in-part application claims priority benefit to pending U.S. Utility application Ser. No. 14/643,118 filed Mar. 10, 2015 which claims priority to U.S. Provisional Patent Application No. 61/951,771 filed Mar. 12, 2014, the entire contents of both are incorporated herein by reference.

BACKGROUND

In large commercial and residential construction projects, accommodations must be made for utility lines and storm water run-off management. For example in commercial building structures, utility lines and cables such as electrical lines, natural gas lines, and communications lines need to be installed in the interior and the exterior of the buildings and connected to local grids and service lines. Inside multi-story commercial buildings, these lines and cables are often routed below floors, above suspended ceilings or within columns and walls inside of buildings. Where routed below floors, architects and civil engineers often have to provide elevated, semi-permanent floor structures to access and route such lines or permanently mount hollow conduits or pipes in the individual concrete floors so lines can initially be installed or future lines routed and serviced.

Further, respecting commercial and residential building structures, storm water, collection, management and retention structures are of increasing concern due to potential environmental impacts of such construction projects. Exterior storm water management systems are often below-grade structures, and are used to manage storm water run-off from impervious surfaces such as roofs, sidewalks, roads, and parking lots. Sub-surface water collection and storage chamber systems can be designed to retain storm water run-off and allow for a much slower discharge of storm water effluents. As an example, such systems can be constructed underneath vehicle parking lots and structures, such that the storage chamber system receives water from drain inlets or other structures, and discharge it over time. An example of existing exterior storm water devices is the Triton Stormwater Solutions chamber management systems.

The design and installation of conventional underground storm water chamber solutions is challenging due to many factors. For example, as underground systems, the space or footprint of the large and lengthy chambers is restricted by the land owned and available for use by these systems. Where a large rectangular space is not available at a site for parallel orientation of multiple chambers, irregular configurations and less than optimal orientations of the chambers are necessary to maximize the spatial volume to retain and gradually disburse the storm water or other water run-off.

Prior storm water retention systems also suffered from disadvantages of having to use large amounts of porous material, for example stones in a certain size range, to fill the excavation void space not occupied by the water retention chambers and the interstitial volume spaces between the underground water retention chambers and other water retention structures. The stone greatly reduces the total void space that is available in an excavation for collection and retention of storm water run-off. It is estimated that the commonly used stone sizes occupy 60-70% of the available void space where installed in prior stormwater retention excavations.

Stone is further expensive to purchase, transport to the jobsite and requires a large storage footprint at the jobsite until it is scheduled for installation in the excavation. Stone is also very heavy and requires large earth moving equipment to move the stone from the transportation trucks to the jobsite storage area on arrival and from the jobsite storage area to the excavation at the scheduled time of installation which could be days or even weeks apart. Typical rental of the large earth moving equipment required for the movement and installation of the stone is a significant expense. If there are unscheduled delays, these installation costs incurred by the use of stone only increase.

There is a need for a robust modular storm water containment system that provides an interior chamber which can be selectively configured to provide multi-directional storm water pathways and serve as a storm water retention chamber for the gradual diffusion of stormwater runoff through the soil column which recharges the aquafer system which in turn replenishes the environment. There is further a need to improve on underground storm water retention systems to improve performance capabilities, system life span and reduce burden and costs.

SUMMARY

Examples of a modular conduit unit for use in creating modular conduit unit structures is disclosed. The applications for the present invention are many and range from use in routing utility lines and cables in concrete floors and walls of commercial buildings to forming underground storm water management and distribution systems. The inventive units and modular structures can be stand along structures, buried under earth or stone or encased in concrete or other materials for permanent application in permanent structures such as high rise commercial buildings.

In one example of the invention, each modular conduit unit has a domed shaped structure and four leg design forming a self-standing, strong unit. The exemplary unit includes four sides with arches extending outward and defining four openings, a pair of openings opposing each other along a respective first or second chamber axis. The unit provides a hollow, interior chamber in communication with the openings.

On connection of the two modular conduit units, extended passageways are formed through the openings for routing of utility lines, cables or other equipment through the passageways. The modular units can be connected to form typical and irregular geometric structures to accommodate the space or footprint provided by a building site. The modular units and connected modular structures can be backfilled around, buried or encased in materials such as concrete while preserving the open passageways for routing or providing an interior storage volume.

In another example having particular usefulness in below ground surface storm water management systems, the modular retention units have a horizontal or planer upper support surface for selected engagement with modular trays. The modular trays serve multiple functions including, but not limited to, a support surface for the excavation backfill material, prevent relative movement of the engaged retention units and adjacent modular trays, and substantially eliminate the need for porous or backfill material to be installed around the retaining units. The improvement or substantial elimination of the need for porous materials for example stones, around the storm water retention device is a significant technical and business improvement over prior systems. In a preferred example, the modular retention units are stackable, further decreasing the foot print required of the materials at the jobsite prior to installation.

Closure panels can be selectively connected to cover selected openings in the unit to customize the structure or completely close it off as a storage volume.

In an exemplary method of forming a modular conduit unit, several individual modular conduit units are connected together to form a first and alternately an additional second passageway through the units for exemplary uses of routing utility lines or managing storm water runoff. Closure panels may be added to close off selected portions of the units or terminate the through passageways.

In an exemplary method having particular usefulness in below ground surface storm water retention applications, a plurality of modular retention units are connected in a desired configuration to accommodate the shape and size of the excavation forming an interior chamber volume to collect and retain storm water run-off. A plurality of modular trays are engaged on upper support surfaces of the retention units which prevent relative movement of the retention units and prevent backfill material from entering interstitial volume spaces between the connected retaining units to thereby preserve a greater amount of the excavation void space for the collection and retention of storm water or other fluids or materials.

Other examples and applications of use of the present invention will be recognized and understood by those skilled in the art on reading the below description and drawings herein.

BRIEF DESCRIPTION OF THE DRAWINGS

The description herein makes reference to the accompanying drawings wherein like reference numerals refer to like parts throughout the several views, and wherein:

FIG. 9 is a perspective view showing an example of three conduit units connected together along two channel axes;

FIG. 10 is a perspective view showing an example of a large number of conduit units connected together and selective application of exemplary closure panel structures;

DETAILED DESCRIPTION OF A PREFERRED EMBODIMENT

Figure 1:
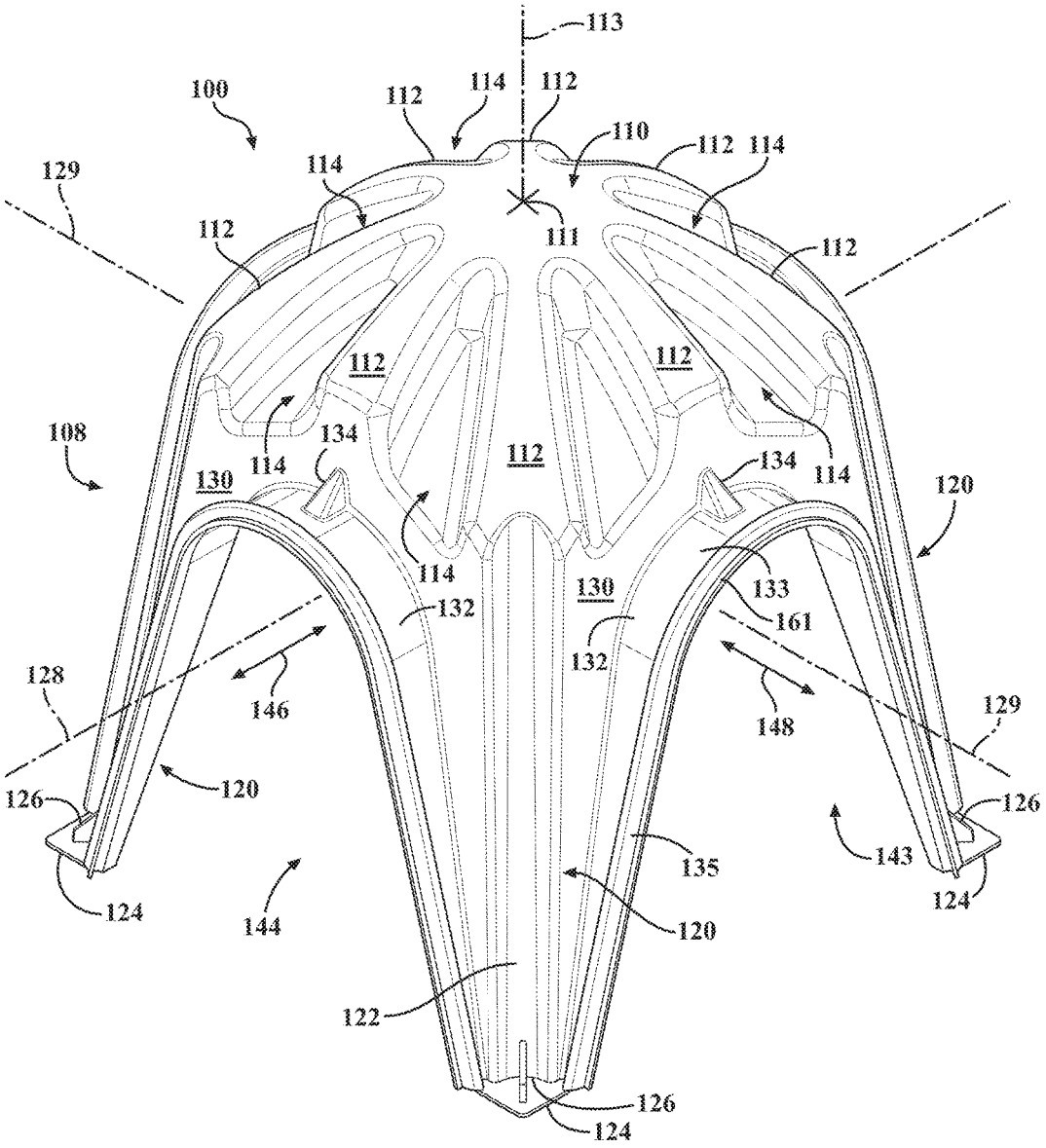
FIG. 1 is a perspective view showing an example of a single modular conduit unit.

An exemplary modular construction conduit unit 100 and methods is shown in exemplary configurations, applications and accessories in FIGS. 1-15.

Examples of an improved modular storm water retention system are discussed below and illustrated in FIGS. 16-27.

Referring to the examples shown in FIGS. 1-5, conduit 100 is a four-legged domed structure having a first side 101, second side 102, third side 103 and a fourth side 104 as generally shown. In the preferred example, conduit 100 includes a bottom portion 108 and a dome-shaped top portion 110 having an apex 111 along a longitudinal axis 113 as generally shown. The top portion 111 radially and gradually slopes down toward four legs 120 ending in foot pads 124 as generally shown.

In the example, the top portion 110 is configured such that, when the conduit unit is covered with a material, for example with gravel, stone or dirt, the material will not easily collect on top of the top portion 110. Instead, the preferred domed shape of the top portion 110 naturally directs the material under the force of gravity to all sides of the conduit 100, thus allowing for even backfilling and distribution of weight around the conduit 100.

In the example shown, conduit unit 100 includes a plurality of formations 112 and 114. In the example shown, formations 112 are in the form of ribs and are continuous with the top portion including apex 111. Exemplary formations 114 are shown in the form of depressions at a lower surface than ribs 112. The formations 112 and 114 and gradual slope of top portion assist in the dispersion of backfill described above and add strength, stiffness and aesthetic qualities of the unit 100. It is understood that exemplary formations 112 and 114 can be in different numbers and take other forms, shapes and configurations than those shown in FIGS. 1-14 depending on the performance and load bearing specifications, environmental applications, material selection and aesthetic considerations.

FIGS. 1-5 show an exemplary modular conduit unit 100. The vault unit 100 can be made of plastic, composites or other materials known by those skilled in the art. As best seen in the example in FIGS. 1-3 and 7, the conduit unit 100 preferably includes four legs 120 that each extend downward from the top portion 110, each positioned at a respective corner of the conduit 100 where pairs of the first side 101, the second side 102, the third side 103, and the fourth side 104 meet. In the preferred example shown, each of the legs 120 includes a formation 122 extending down the length of the leg 120. It is understood that formation 112 may vary as previously described above for formations 112 and 114. In the example, legs 120 angle downwardly and radially outwardly from longitudinal axis 113. It is understood that legs 120 may extend at other angles and orientations as known by those skilled in the art.

In the example, each leg 120 terminates at a foot pad 124 having, for example, a generally planar surface that is configured to contact an underlying surface 125 and thereby support the conduit unit 100. The foot pads 124 can be configured to help align the conduit 100 during installation, by placing the conduit units 100 such that the edges of foot pads 124 on adjacent vault units 100 are positioned closely adjacent to one another and in a proper orientation for engagement as described below and generally shown in FIG. 14.

Figure 2:
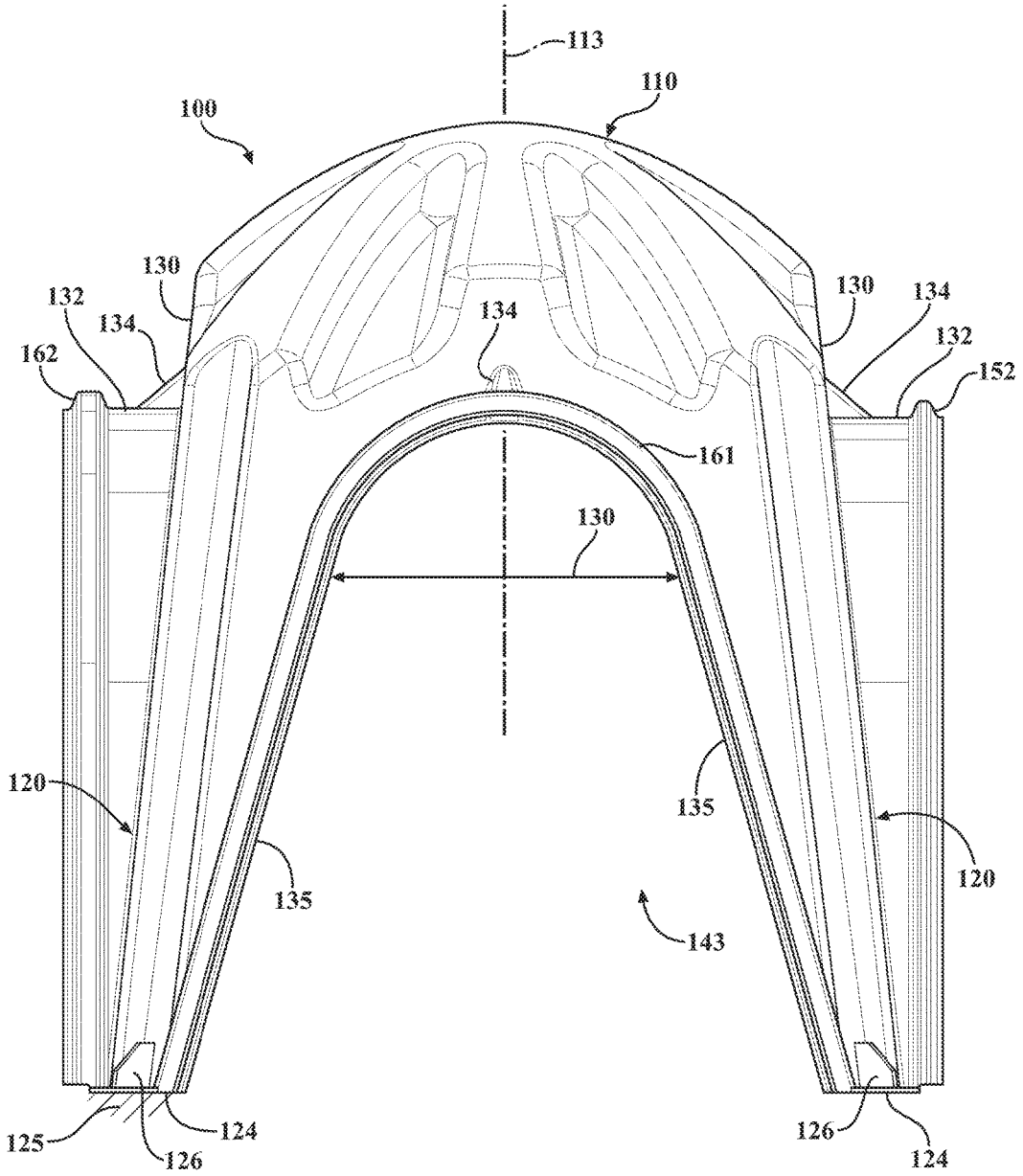
FIG. 2 is a front view of the conduit unit shown in FIG. 1.
Figure 3:
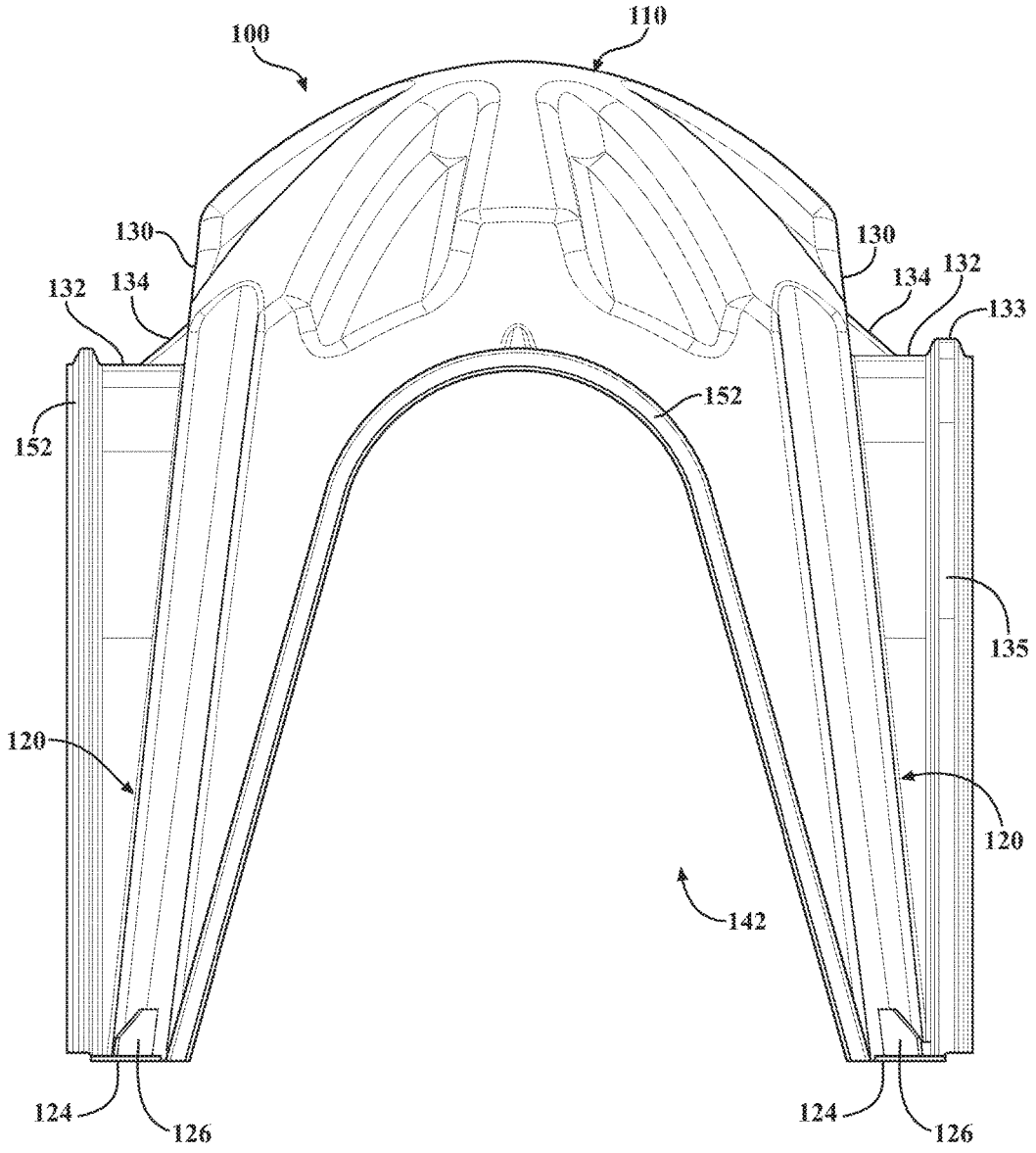
FIG. 3 is a rear view of the conduit unit shown in FIG. 1.

In the preferred example as best seen in FIGS. 2 and 3, a plate member 126 interconnects each of the legs 120 with the respective foot pad 124. Each plate member 126 is a generally planar member that extends upward from and substantially perpendicular to the respective foot pad 124. The plate members 126 can each extend in a direction that is aligned radially with the center and longitudinal axis 113 of the vault unit 100. The plate members 126 each serve to stiffen the legs 120 and the foot pads 124. The plate members 126 can also help the vault units 100 to keep their shape prior to installation, such as when the vault units 100 are stacked for shipping. The plate members 126 can also serve a locating function, as will be described further herein. It is understood that structures other than plate member 126 may be used where needed to reinforce the joint between the legs 120 and foot pads 124. Where performance specifications or other factors do not require it, plate 126 can be eliminated.

In the illustrated preferred example of conduit unit 100, each of the first side 101, the second side 102, the third side 103, and the fourth side 104, define a generally planar surface 130. Each surface 130 is bordered by a pair of the legs 120 and the top portion 110. An upstanding arch 132 extends axially outward along a first chamber axis 128 or second chamber axis 129 which preferably intersect longitudinal axis 113 as generally shown. In the example, each arch 132 includes a circular portion 133 at its top and straight portions 135 that each extend downward from a respective side of the circular portion 133 toward the bottom of the conduit unit 100, and taper laterally outward from the respective chamber axis 128 or 129 toward the corners of the conduit unit 100

In the example, each side 102, 102, 103 and 104 each include a diverter connecting one of the generally planar surfaces 130 with a respective one of the upstanding arches 132 as generally shown. Each diverter member is positioned at the top of one of the upstanding arch members 132, and extends upward from the arch member 132 and inward toward the respective generally planar surface 130. The upper surfaces of each diverter member slope axially outward along a respective chamber axis 128 or 129 in a pyramidal configuration. Preferably, the diverter members 134 are configured such that, when the conduit 100 is covered with a material such as by backfilling with gravel, stone, concrete or dirt, the material will not collect on top of each arch member 132, but instead is directed to the sides of each arch member 132, thus allowing for even backfilling around the vault unit 100 and undue stress on the arch 132 until the conduit is properly surrounded and positionally stabilized by the backfill material.

In the exemplary conduit unit 100, the top portion 110 and sides 101-104 define a hollow interior chamber 138 beneath top portion 110.

Referring to FIGS. 1-3, the conduit unit 100 preferably defines four openings that are each positioned between a respective pair of the legs 120. In the exemplary unit 100, a first opening 141, a second opening 142, a third opening 143, and a fourth opening 144 are formed on each of a respective first side 101, the second side 102, the third side 103, and the fourth side 104. The first through fourth openings 141-144 are each bordered by or defined by a respective one of the arch members 132 and are in communication with interior chamber 138. Thus, in the example, each of the first through fourth openings 141-144 can each be substantially arch-shaped. For example, each arch-shaped opening includes a circular portion 133 having a diameter 130 and straight portions 135 defining a periphery 136. In a preferred example, straight portions extend angularly outward such that at the bottom of the opening, the opening distance between the legs 120 is larger than the circular portion and diameter. It is understood that the arches 132 and openings 141-144 can take other shapes, sizes and orientations as known by those skilled in the art.

In a preferred example, the opposing first 141 and fourth 144 openings are substantially aligned along first chamber axis 128 defining a first through passage 146 along first chamber axis 128. Similarly, second 142 and third 143 openings are substantially aligned along second chamber axis 129 and define a second through passage 148 as generally shown.

Figure 4:
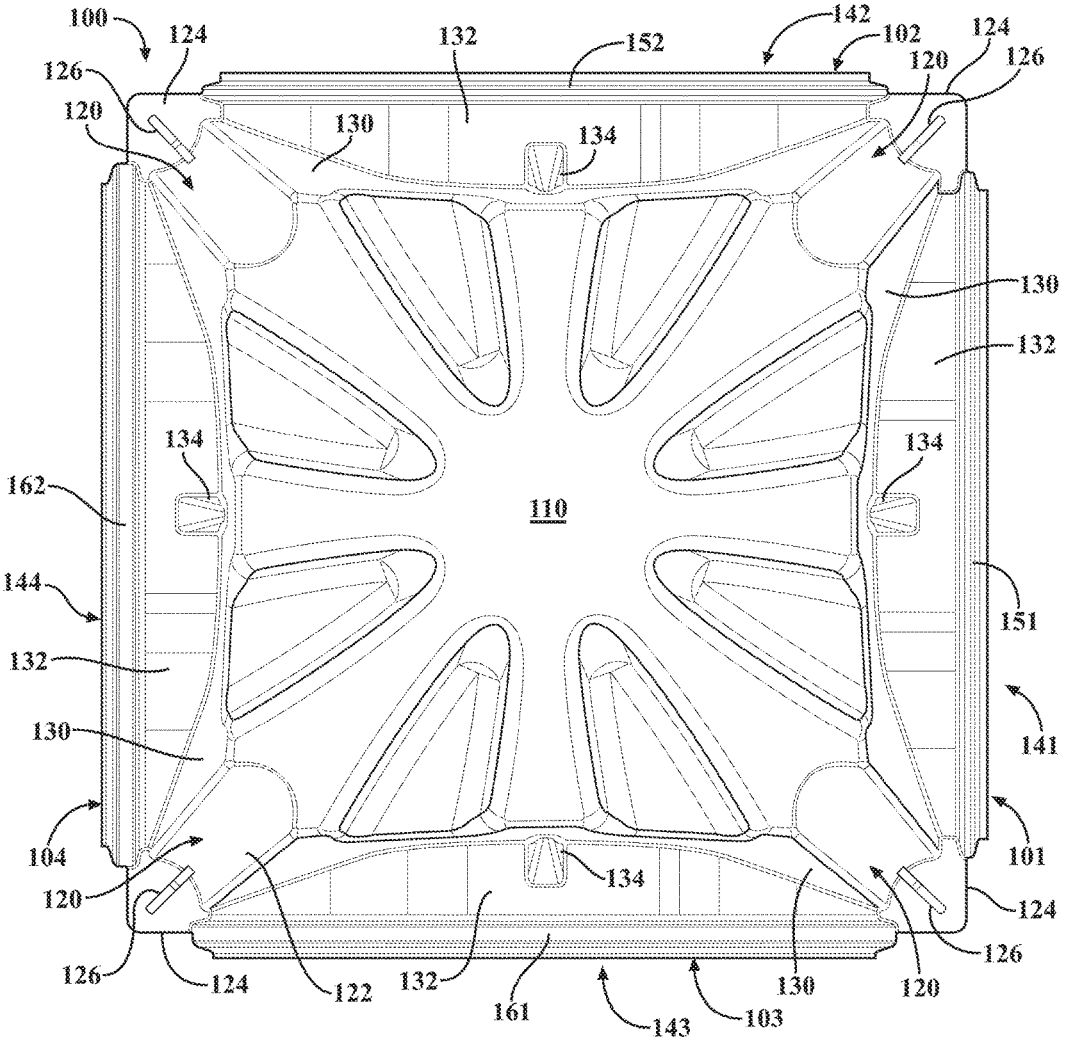
FIG. 4 is a top view of the conduit unit shown in FIG. 1.
Figure 5:
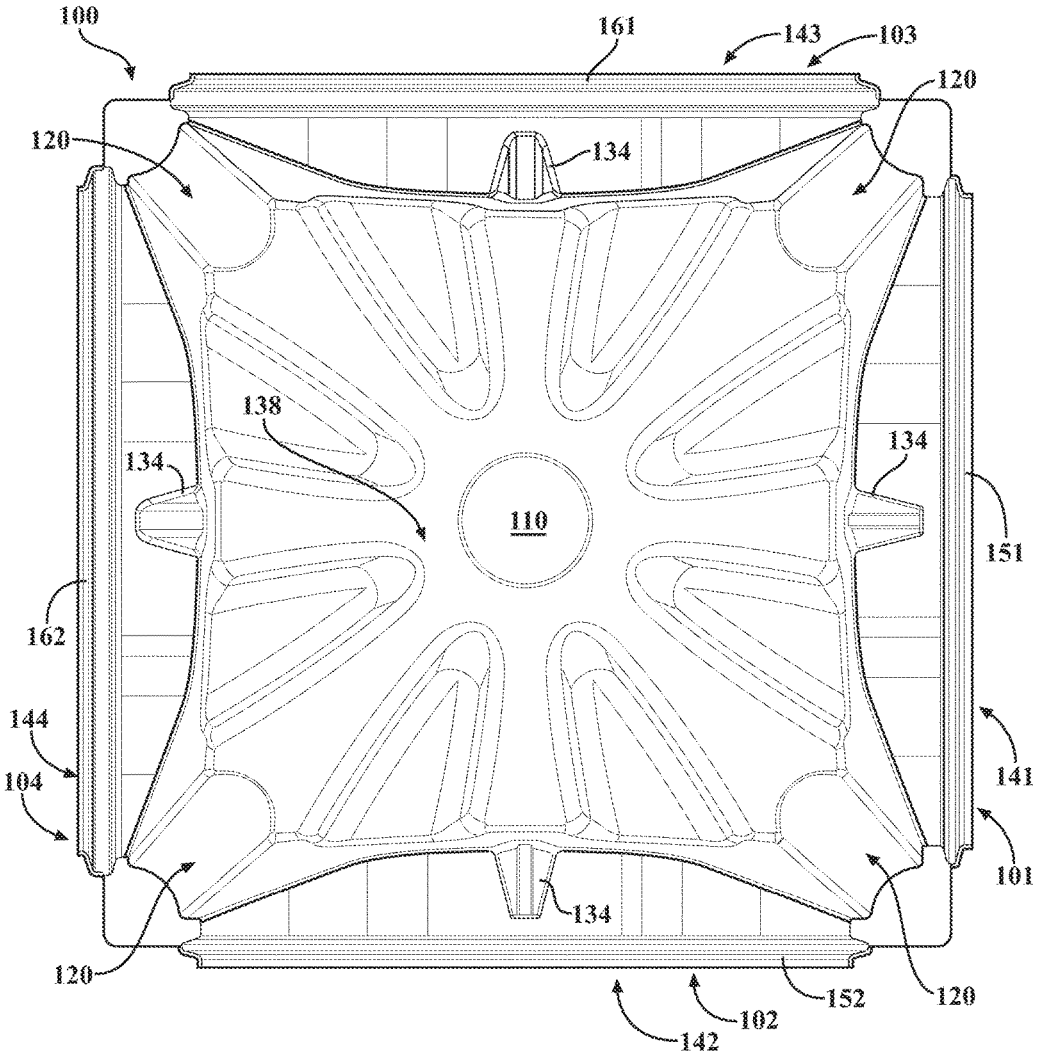
FIG. 5 is a bottom view of the conduit unit shown in FIG. 1.

In the exemplary and preferred modular conduit unit 100 illustrated, each conduit unit 100 includes connecting structures that allow the unit 100 to be connected to similar or identical conduit units 100. In one example of a conduit unit 100 connecting structure and as best seen in FIGS. 4 and 5, two first connector portions in the exemplary form of or a first male connector 151 and a second male connector 152 border the first opening 141 and the second opening 142 respectively as best seen in FIG. 4 In a preferred example, first connector portions 151 and 152 are integrally formed in respective arches 132 on adjacent sides and are upstanding, generally rounded portions extending radially outward from respective chamber axes 128 and 129.

In a preferred example of conduit 100, two second connector in an exemplary form of female connector 161 and a second female connector 162 border the third opening 143 and the fourth opening 144 respectively on the respective arch members 132.

As used herein, the terms "male" and "female" indicate structures that are configured to be complementary and connectable to each other in either a removable or permanent nature. Thus, "male" structures have geometrical configurations that are complementary to female structures. The terms "male" and "female" are not, however, intended to imply or be limited to any particular structure. It is understood that the illustrated first and second male and first and second female connectors may take other forms, shapes or configurations as known by those skilled in the art. It is further understood that other structures and methods of connecting conduit units 100 together may be used, for example, mechanical fasteners including bolts, nuts, screws, rivets and other mechanical fasteners known by those skilled in the art. It is also contemplated that other methods and devices such as staking, use of adhesives and other methods to removably or permanently connect or bond the units 100 together may be used.

Figure 6A:
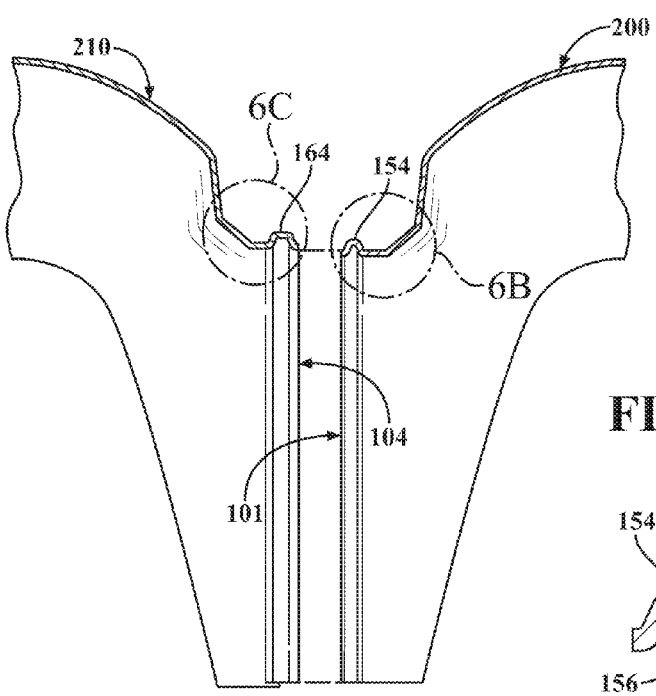
FIG. 6A is an exemplary exploded cross-section views showing a first conduit unit and a second conduit unit in a disengaged position and an engaged position respectively.
Figure 6B:
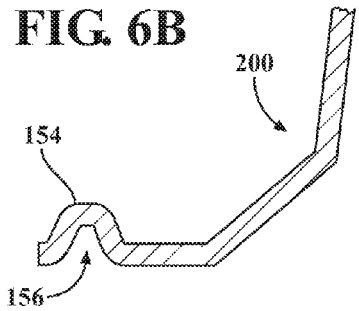
FIG. 6B is an exemplary cross-section view showing the conduit units in FIG. 6A engaged.
Figure 6C:
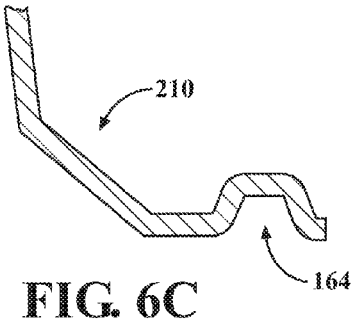
FIG. 6C is an enlarged portion in the area C in FIG. 6A.

In a preferred example as best seen in FIGS. 6A-6D, each of the exemplary first 151 and second 152 male connectors include at least one protrusion 154 having an exemplary rounded configuration, and the first 161 and second 162 female connectors having an exemplary recess or channel configuration that is complementary in shape to the first connector portion. In a preferred example, the at least one protrusion 154 defined by the first connector portions 151, 152 is an elongate lip that extends along the respective arch member 132, and the at least one channel defined by the second connecting portions 161, 162 is an elongate channel that extends along the respective arch member 132, wherein the elongate lip of each respective first connector portion 151, 152 is receivable in the elongate channel of each respective second connector portion 161, 162 on a connecting conduit unit 100. As another example, the at least one protrusion 154 defined by the first connector portion 151, 152 may be in the form of a plurality of radially extending posts that are arrayed along the respective arch member 132, and the at least one channel defined by the second connector portion 161, 162 may be a plurality of complementary apertures that are arrayed along the respective arch member (not shown). As generally shown in FIG. 6B, preferably a continuous recess or channel 156 is formed on the opposing side of the material opposite the rounded protrusion 154.

In a preferred example as best seen in FIG. 4, the first male connector 151 and the second male connector 152 are located on the first side 101 and the second side 102, respectively, and thus are on adjacent sides that are generally orthogonal to one another. Similarly, the first female connector 161 and the second female connector 162 are located on the third side 103 and the fourth side 104, respectively, and thus are on adjacent sides that are generally orthogonal to one another. In the preferred example and configuration the male and female connecting structures are positioned opposite one another along respective channel axes 128 and 129 on the conduit unit 100. This allows multiple units to be connected together easily in any desired direction while maintaining consistent orientation of the multiple vault units. It is understood that different configurations or combinations of the first connector and second connector portions may be used to suit the particular application and desired configuration of portions or a complete conduit system.

In a preferred example, modular conduit unit 100 is a thin-walled, unitary one-piece structure formed of plastic resin in a molding process. In a preferred example, the unit 100 is 36 inches tall and 30 inches on a side between outermost portions of foot pads 124. It is understood that other polymers, composite resins, non-ferrous metals and other materials known by those skilled in the art may be used. It is further understood that conduit unit 100 may be of different sizes, shapes and configurations and by different processes than that shown and described in the examples, to suit the particular application and performance and environmental specifications.

FIGS. 6A-6D show an exemplary first conduit unit 200 and a second conduit unit 210 in a disengaged position (FIG. 6A), and an engaged position (FIG. 6B). The first conduit unit 200 and the second conduit unit 210 are as described with respect to the conduit unit 100 and first and second connector portions previously described and illustrated.

Figure 6D:
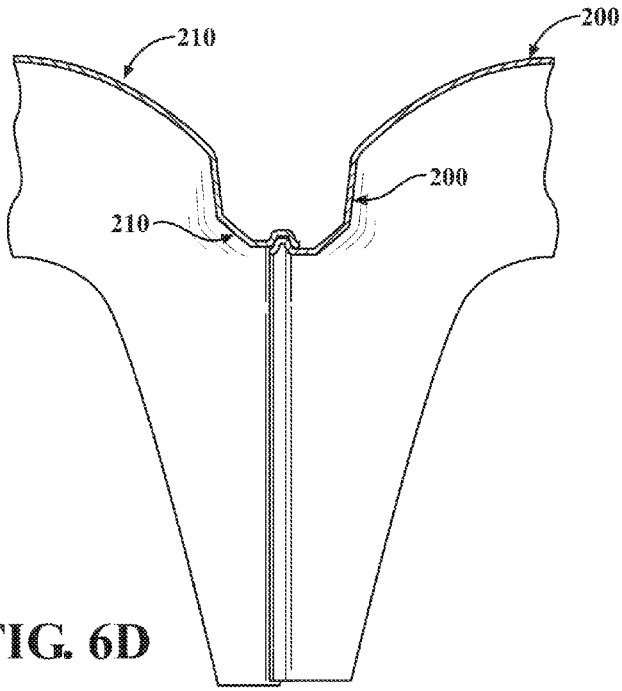
FIG. 6D is an enlarged portion in the area of D in FIG. 6A.

In an exemplary connection of a first 200 and a second 210 conduit unit, a first side 101 of first conduit unit 200 channel 164 is generally aligned along channel axis 128 with a fourth side 104 of a second conduit unit 210. Due in part to the angularly sloped portions of arches 132 and complementary first and second connector portions, the second conduit unit 210 can be raised along longitudinal axis 113 and lowered down over arch 132 of the first conduit unit 200 to engage the second connector portion channel 164 with the first connector portion protrusion 154 as generally shown in FIG. 6D. The same or similar process is used to connect additional modular conduit units 100 to the second 102 and third 103 sides by aligning the complementary first and second connector portions of the additional units 100. Other methods to align and engage the first and second connector portions known by those skilled in the art may be used.

Figure 7:
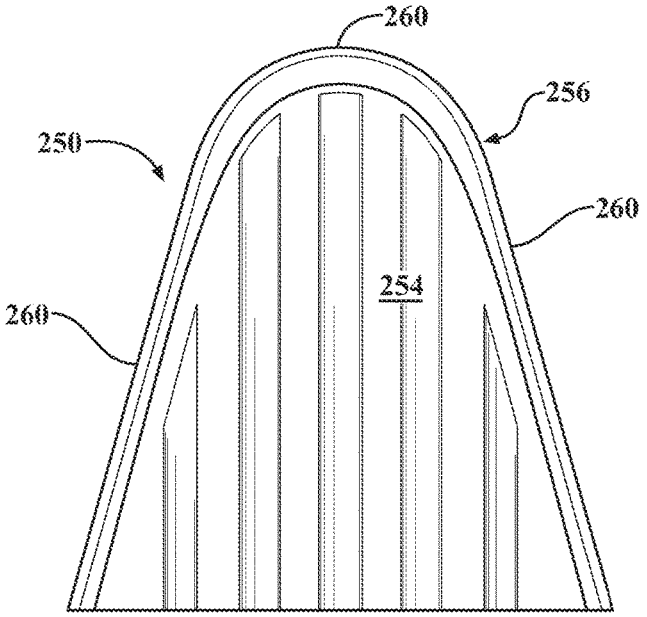
FIG. 7 is a front view of an exemplary conduit unit closure panel.
Figure 8:
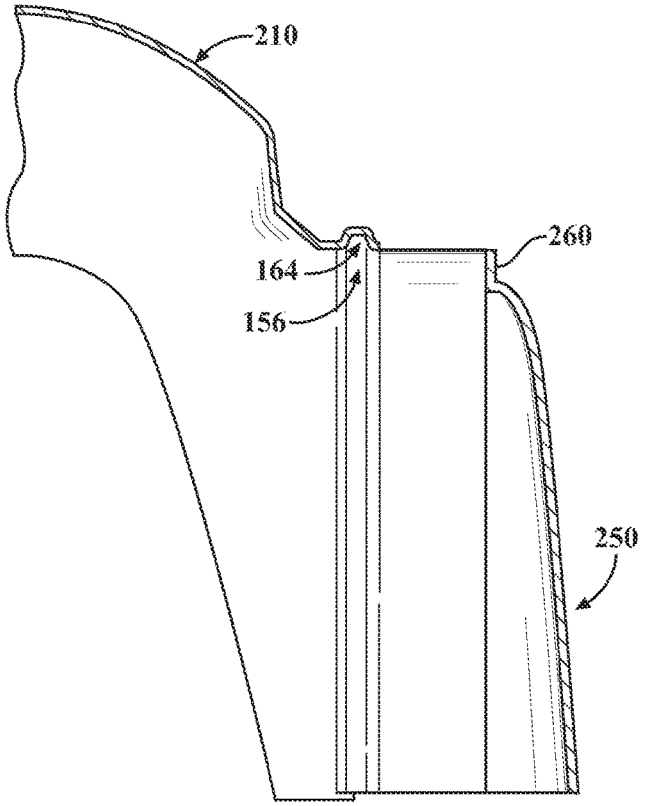
FIG. 8 is a cross-section exploded view showing an example of a conduit unit and a closure panel.

Referring to FIG. 7 an exemplary closure panel or door 250 is shown. In the example, closure panel 250 includes a contoured surface 254 and a periphery 256 that is substantially sized and shaped to cover a respective one of the first 141, second 142, third 143 or fourth 144 openings in conduit 100. Closure panel 250 surface 254 is preferably contoured to deter collection of backfill material on the panel as described above. It is understood that surface 254 may take other shapes, configurations and sizes to compliment the structures of conduit 100 and to accommodate the performance specifications and application as known by those skilled in the art.

In one example, panel 250 periphery 256 includes a third connector portion which is complementary and engageable with either of the unit 100 first connector or second connector portions, for example the channel 164 or protrusion 154. In a preferred example best seen in FIG. 8, closure panel third connector portion includes an upstanding flange or lip 260 extending substantially along the entire periphery 256.

Where it is desired to close off a conduit opening 141, 142, 143 and/or 144, for example where multiple conduit units 100 are used as a storm water retention and distribution system, one closure panel 250 may be used for a respective opening as generally shown in FIG. 10. Closure panel 250 is installed in a similar way to the addition and connection of a second conduit unit 210 as described above. In the preferred example, flange 260 is oriented with a respective opening and flange 260 is inserted into channel 164 or recess 156 to engage the panel 250 to the conduit unit 100. In an alternate example not shown, periphery 256 may include a channel or recess complementary to and that overlaps and engages protrusions 154 or similar formations on a respective arch 132. It is understood that closure panel 250 can be connected to conduit 100 in different ways through fasteners and other methods described above for connection of multiple conduit units 100.

In another example of modular conduit unit 100, a bottom or floor panel (not shown) may be used to partially or substantially cover or close the normally open portion between conduit legs 120 and in the areas of the openings 141-144. The exemplary floor panel may be an independent panel or integrally formed with the other portions of conduit 100. Where not integral, connector structures may be included to removably or permanently secure the floor panel to the conduit unit 100, for example foot pads 124, by methods described above or known by those skilled in the art. The exemplary floor panel can be generally planer or have formations or contours to suit the particular application or performance specifications.

As described, in a preferred application or method of use, a plurality of individual modular conduit units 100 are selectively connected together along one or both of channel axes 128 and 129 forming one or a plurality of first 146 and/or second 148 through passages where closure panels 250 are not used. As described and best seen in FIG. 12, each conduit unit 100 includes a hollow chamber 138. As additional conduit units 100 are added and connected, the through passage 146 and/or 148 increases in length as does the volume of the combined hollow chambers providing for increased retention, for example in a storm water retention system.

In an exemplary application as shown in FIG. 9, an exemplary structure 280 is shown. In the example, three conduit units 100, a first 200, a second 210 and a third 290 are connected together along first 128 and second 129 axes forming multiple first 146 and second 148 through passages, for example routing of lines or cables in a commercial building.

In an alternate modular conduit structure 300 example shown in FIG. 10, a plurality of individual modular conduit units 100 are connected together along multiple first 128 and second 129 axes to form a plurality of first 146 and second 148 through passages and hollow chambers 138 inside the structure 300. In the example, many of the exterior or peripheral units 100 include closure panels 250 on two or more of the respective openings 141-144. As described, the modular conduit units 100 structures may take many geometric forms to accommodate the space at an application site and to meet performance and environmental specifications.

Figure 11:
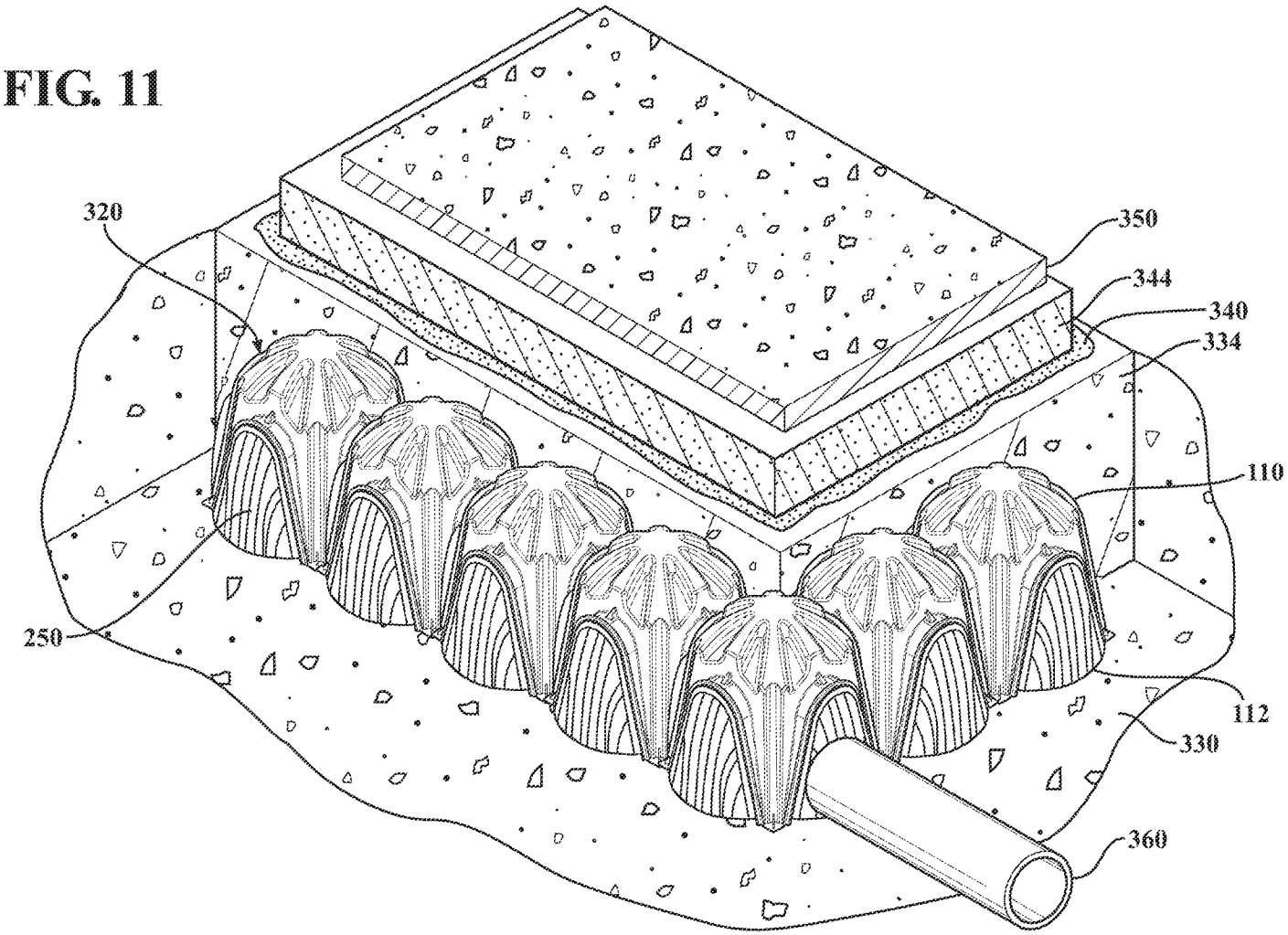
FIG. 11 is a perspective view showing an exemplary application of multiple conduit units and doors configured as a below-grade water retention and dispersion structure.

FIG. 11 shows an alternate example conduit unit structure 320 that is being utilized as below-grade water detention structure which is placed under, for example, a parking lot. The exemplary conduit structure 320 includes multiple conduit units 100 that are connected together along both axis 128 and 129, and selectively provided with closure panels 250 1120 to close or seal unconnected openings 141-144, thereby defining an enclosed interior volume defined by the plurality of interior hollow chambers 138. In the example, the plurality of conduit units 100 are placed on top of a first layer of porous material 330, such as gravel, stone, sand, and or other materials, and are surrounded or backfilled by a second layer of porous material 334. Additional upper layers may include for example a geotextile layer 340, a base layer 344, and a pavement layer 350 (for example, asphalt or concrete). In the example, a fluid inlet pipe 360 extends through one of the closure panels 250 for ingress and/or egress of fluid to and from the interior volume defined by the interior hollow chambers 138. As described, closure panels 250 may be selectively used to close off certain or all of the first 146 and second 148 through passages on the exterior or interior of the unit structure. In one example and application, after water enters the conduit structure 320 via the inlet pipe 360, the water subsequently exits the conduit structure 320 by infiltration into and through the first layer of porous material 330.

Depending on the application, it is understood that other structures and methods may be used to ingress, egress or manage fluids from the exemplary modular conduit structures described and contemplated herein. In an example not shown, a row or multiple rows of connected conduit units 100 along an axis 128 or 129 can be connected and used to form a header row or chamber to initially collect storm water before being allowed to pass from the header row of units 100 to secondary or overflow chambers defined by additional connected units 100 connected to the header row by transfer pipes through door closure panels 250 or direct connection of additional units 100 as described herein. For example, see U.S. Patent Publication No. US2013/0008841A1 owned by the present inventor and incorporated herein by reference. Other configurations and applications known by those skilled in the art may be used.

Referring to FIGS. 16-27 an example of a modular storm water retention system 1010 is illustrated and discussed below. Where identical or similar structures are used with prior examples, the same reference numbers are used in the illustrations for convenience and not for purposes of limitation.

Figure 16:
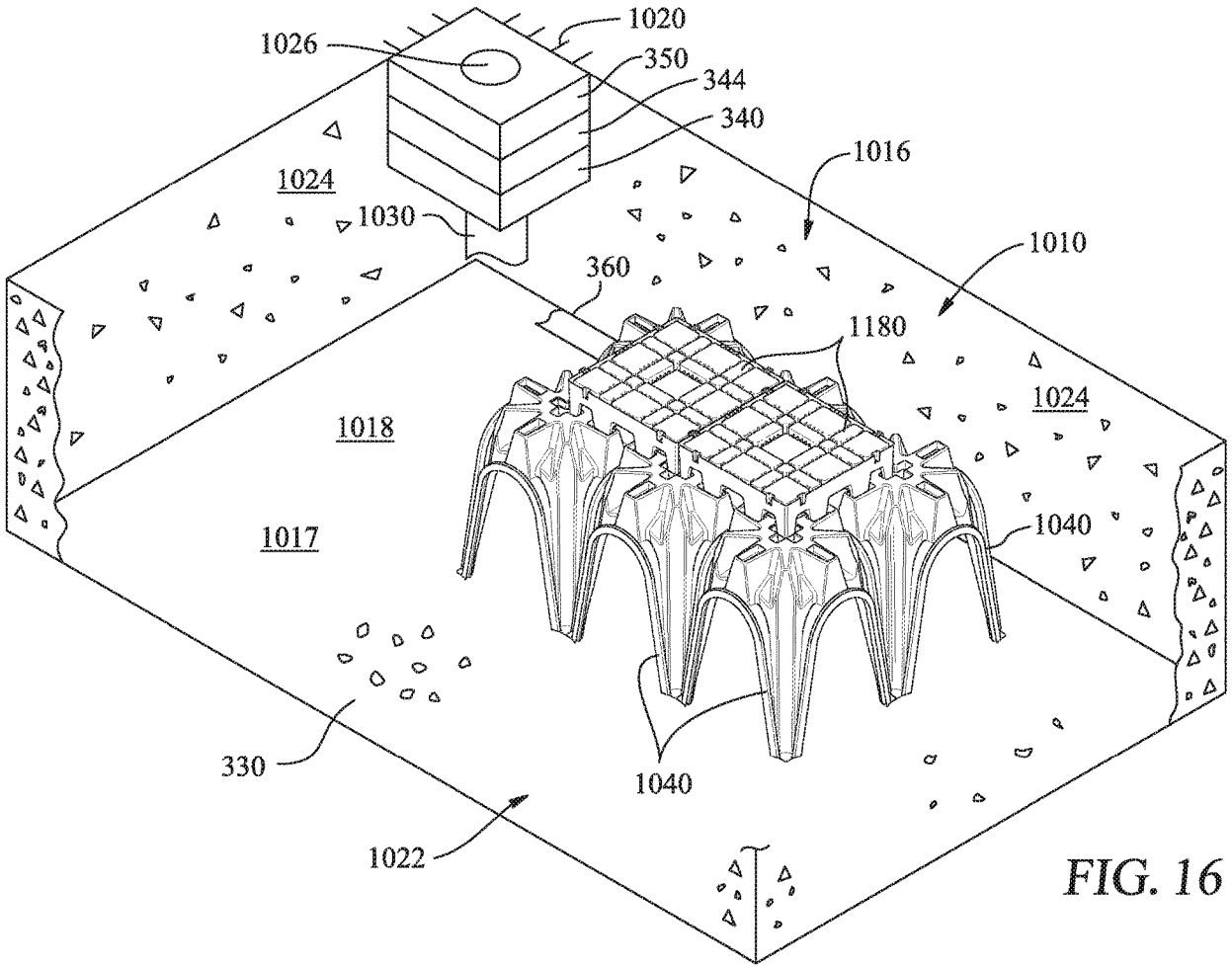
FIG. 16 is a schematic perspective view of an exemplary alternate storm water management system in an below ground surface excavation.

Referring to FIG. 16 an example of one possible configuration of connected individual storm water retention units 1040 is shown positioned on a support surface of porous material 330 in an excavation 1016 below ground level 1020 as generally shown. In the example, six (6) individual modular retention units 1040 are shown interconnected with two (2) interconnected trays 1180 discussed further below.

In the FIG. 16 example and as similarly described for FIG. 11, the modular storm water retention system 1010 may be used to collect and retain for controlled dispersion storm water collected through a storm water drain 1026, for example in a retail store parking lot. The drain 1026 is connected to a down pipe 1030 which connect to one or more inlet pipes 360 (one shown) leading into the modular retention structure 1010 as further discussed below. As described for FIG. 11, down pipe 1030 may first direct water into a row or configuration of units 1040 called a header row (not shown). The header may have additional pipes to channel water reaching a certain height in the header into one or more configurations 1010 of interconnected units 1040. For example, see U.S. Patent Publication No. US2013/0008841A1.

As further discussed below, in a preferred application and use, modular units 1040 would occupy substantially all of the size/area of the excavation 1016 footprint 1017 and as much void space volume 1018 of the excavation 1016 as possible, considering necessary backfill materials, to minimize the ground footprint required while maximizing the void space 1018 to collect storm water run-off (excess void space 1018 shown between the excavation earthen walls and exemplary system 1010 in FIG. 16 for ease of illustration only). The remaining volume or void space 1018 of the excavation, and space above the retention device 1010 may be filled with geotile 340, a base layer 344 and pavement 350 as generally shown and described above for FIG. 11. These materials 340, 344, and other materials known by those skilled in the art, used to backfill or refill excavation 1016 are referred herein as "backfill" materials. Other materials, configurations of structure 1010 and applications known by those skilled in the art may be used.

Figure 17:
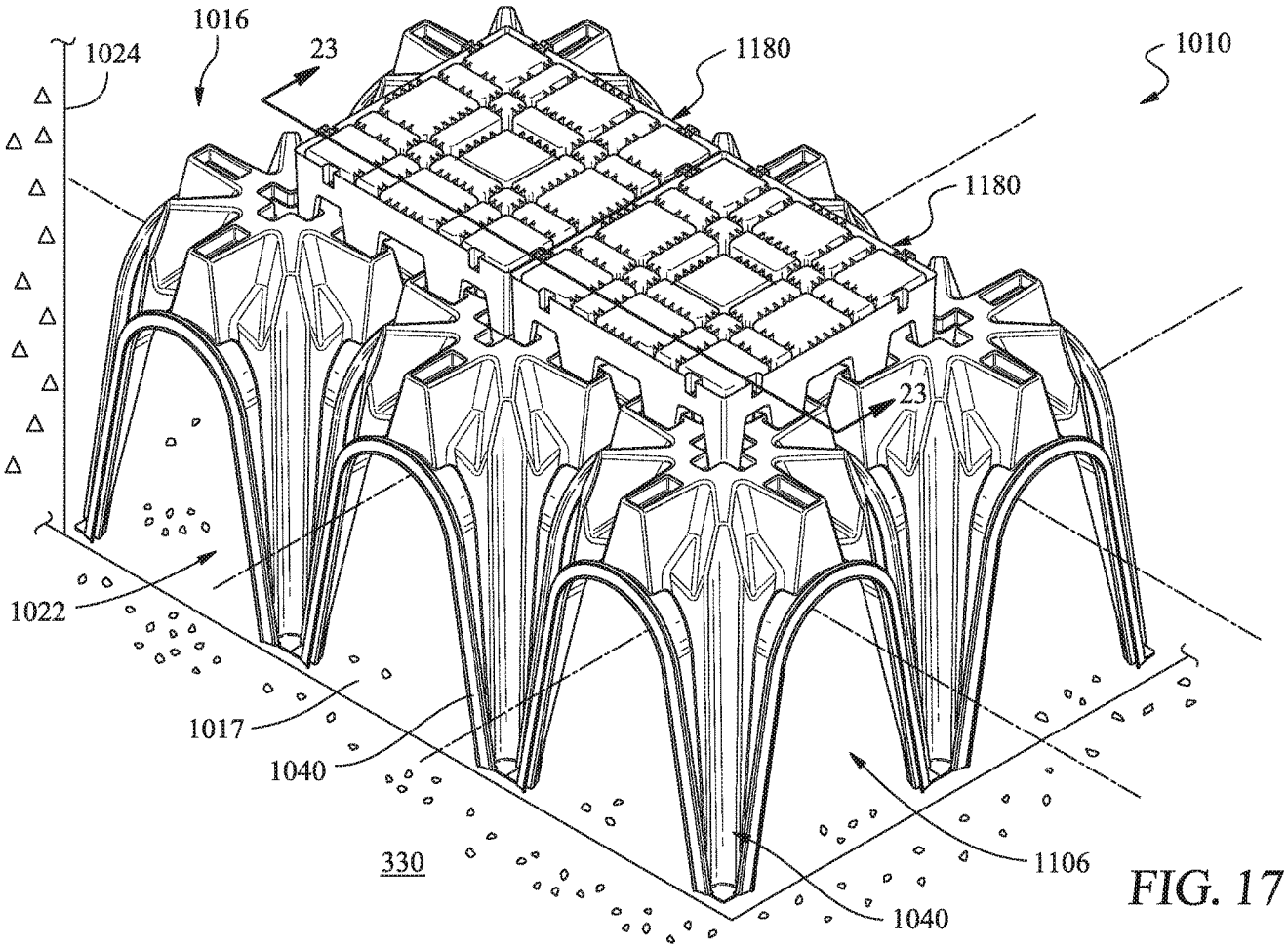
FIG. 17 is an enlarged view of a portion of FIG. 16.
Figure 18:
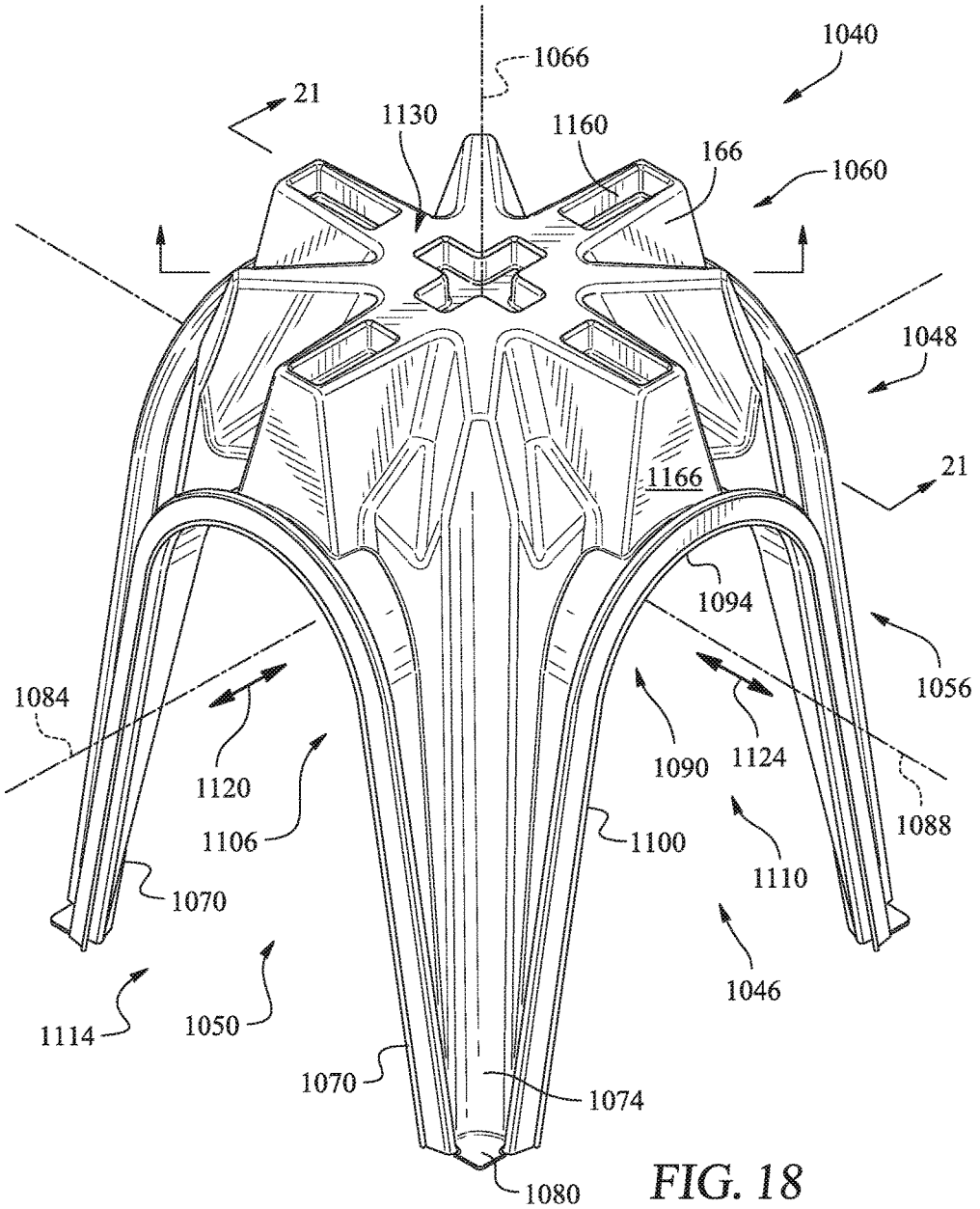
FIG. 18 is a perspective view of an example of the modular storm water retention unit in FIG. 17.

Referring to FIGS. 17 and 18, exemplary modular retention unit 1040 includes a first side 1046, second side 1048, third side 1050 and fourth side 1052 as generally shown. Unit 1040 generally has a bottom portion 1056 and a top portion 1056 having a longitudinal axis 1066 which define an interior chamber 1106 for collecting and retaining storm water, and other fluids and materials, as further described below and known by those skilled in the art.

In the example unit 1040, four similarly configured legs 1070 are used each having a formation 1074 as generally shown. Foot pads 1080 are used at the lower ends of the legs for placement on a support surface, for example a layer of porous material, preferably crushed or processed stone of a selected predetermined size. Each of the respective sides of the unit 1040 includes an arch structure 1090 including a circular portion 1094 and a straight portion 1100 as previously described for FIGS. 1-3 above. The respective arches 1090 each include one of a first opening 1110, second opening 1112, third opening 1114 and fourth opening 1116 defining first 1084 and second 1088 chamber axis forming respective through passageways 1120 and 1124 as generally shown and previously described for FIGS. 1-3.

In the example unit 1040, each arch 1090 includes either a male or female connector for interconnection of adjacent units 1040 as described above for FIGS. 4-6D above. Other methods of interconnecting pluralities of units 1040 to form desired configurations known by those skilled in the art may be used. As generally described above for FIGS. 9-11, a plurality of units 1040 may be connected together to form different liquid retainment configurations suitable to the particular application and performance specifications as known by those skilled in the art. For the reasons described below, preferably sufficient units 1040 are used and interconnected to substantially fill the surface area of the support surface area 330 of the excavation 1016. It is understood that the excavation support surface 330 does not have to be a layer of porous material 330, such as stone, but may be resident earth or other materials suitable for the application and known by those skilled in the art.

Figure 19:
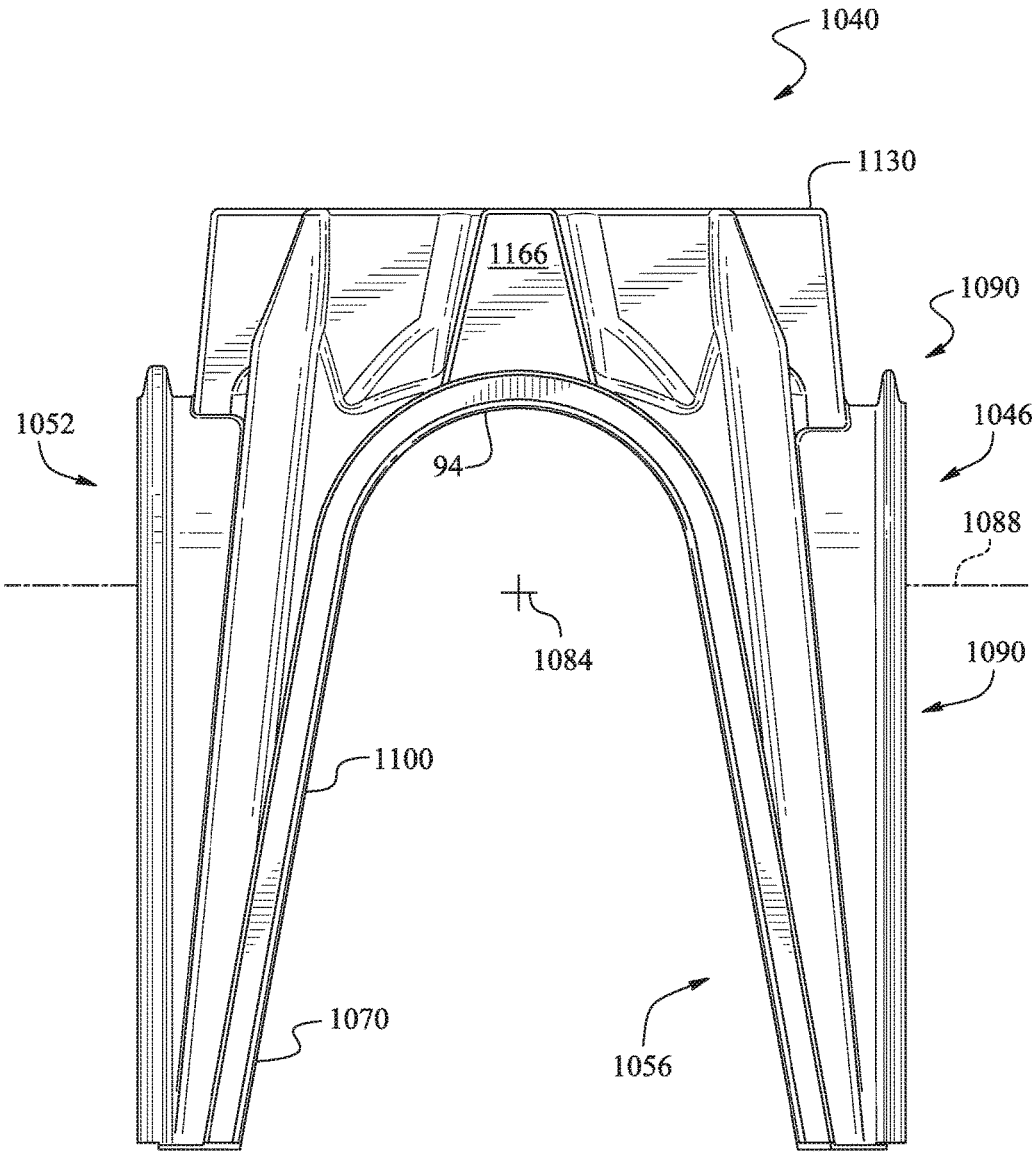
FIG. 19 is a side view of the exemplary unit in FIG. 18.
Figure 20:
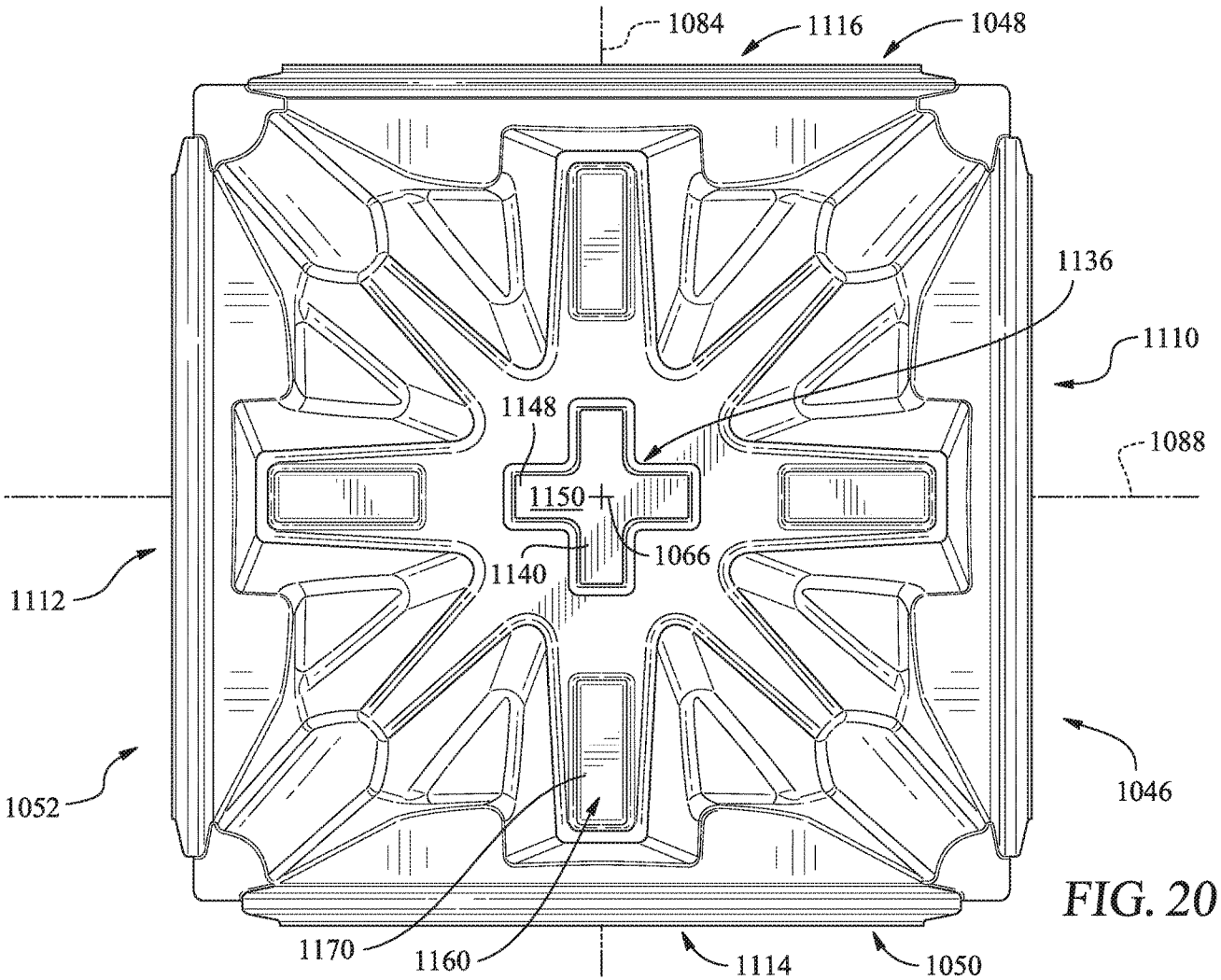
FIG. 20 is a top view of the exemplary unit in FIG. 18.
Figure 21:
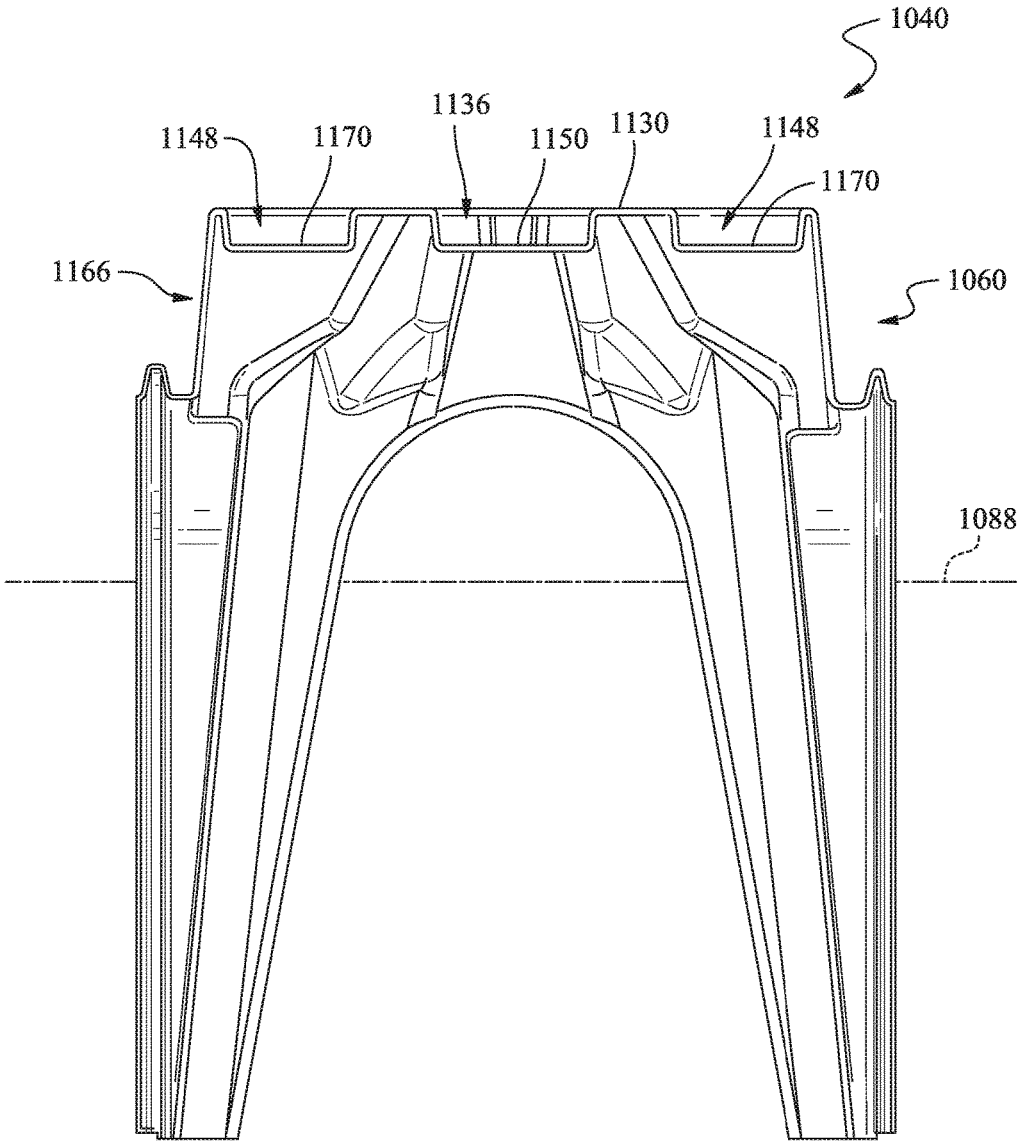
FIG. 21 is a cross-sectional view taken along line 21-21 in FIG. 18.
Figure 22:
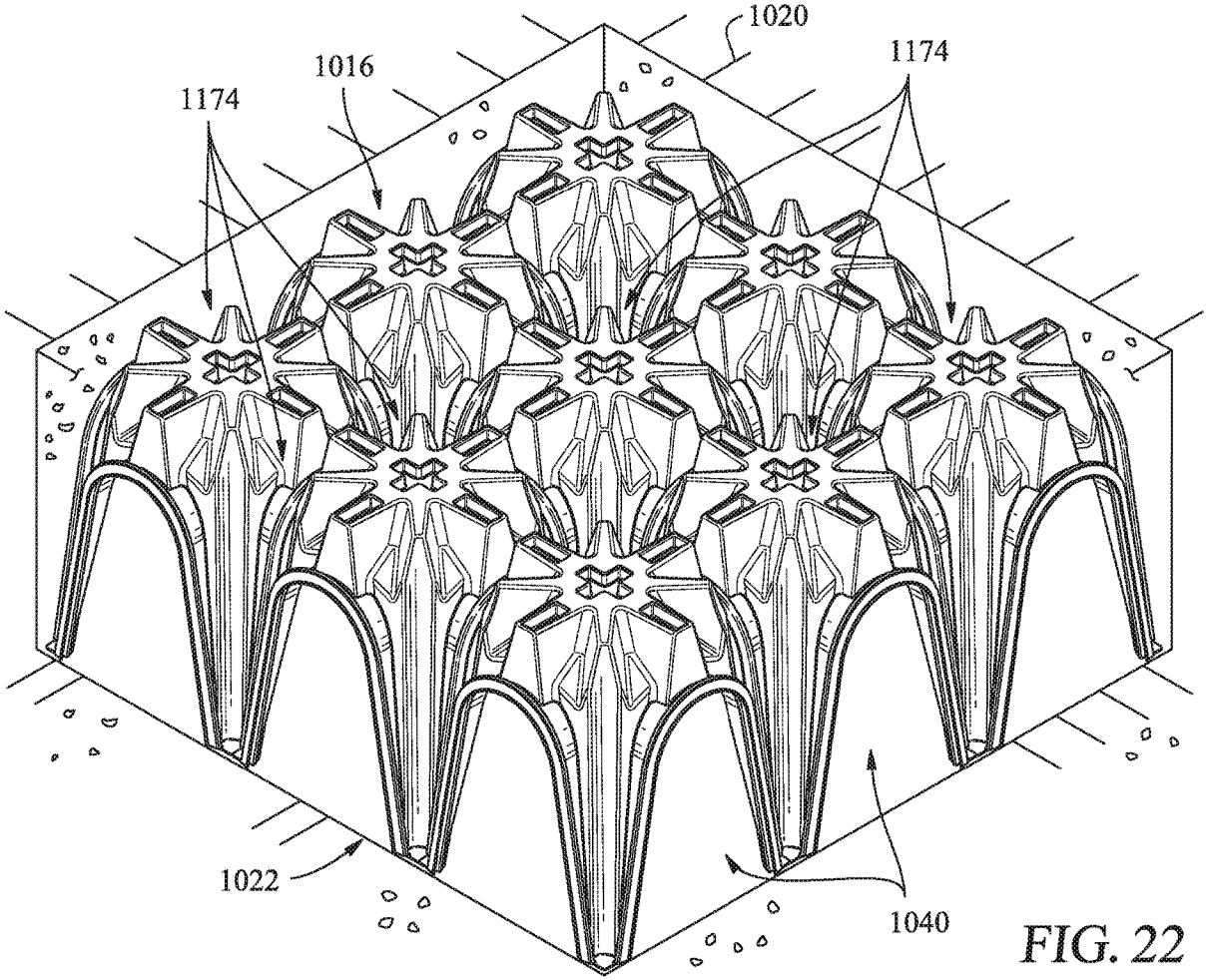
FIG. 22 is a schematic alternate perspective view of the system shown in FIG. 16 without the exemplary trays.

Referring to FIG. 18, exemplary modular unit 1040 top portion 1060 includes a support surface 1130 which is preferably horizontal and/or planer as best seen in FIG. 19. In the example, support surface 1130 includes a first central recess 1140 preferably including a first channel 1140 positioned substantially parallel to first chamber axis 1084 and a second channel 1148 substantially parallel to second chamber axis 1088 as best seen in FIG. 20 forming a cross pattern. Each channel 1140 and 1148 include a channel support surface 1150 as best seen in FIGS. 21 and 22.

Figure 23:
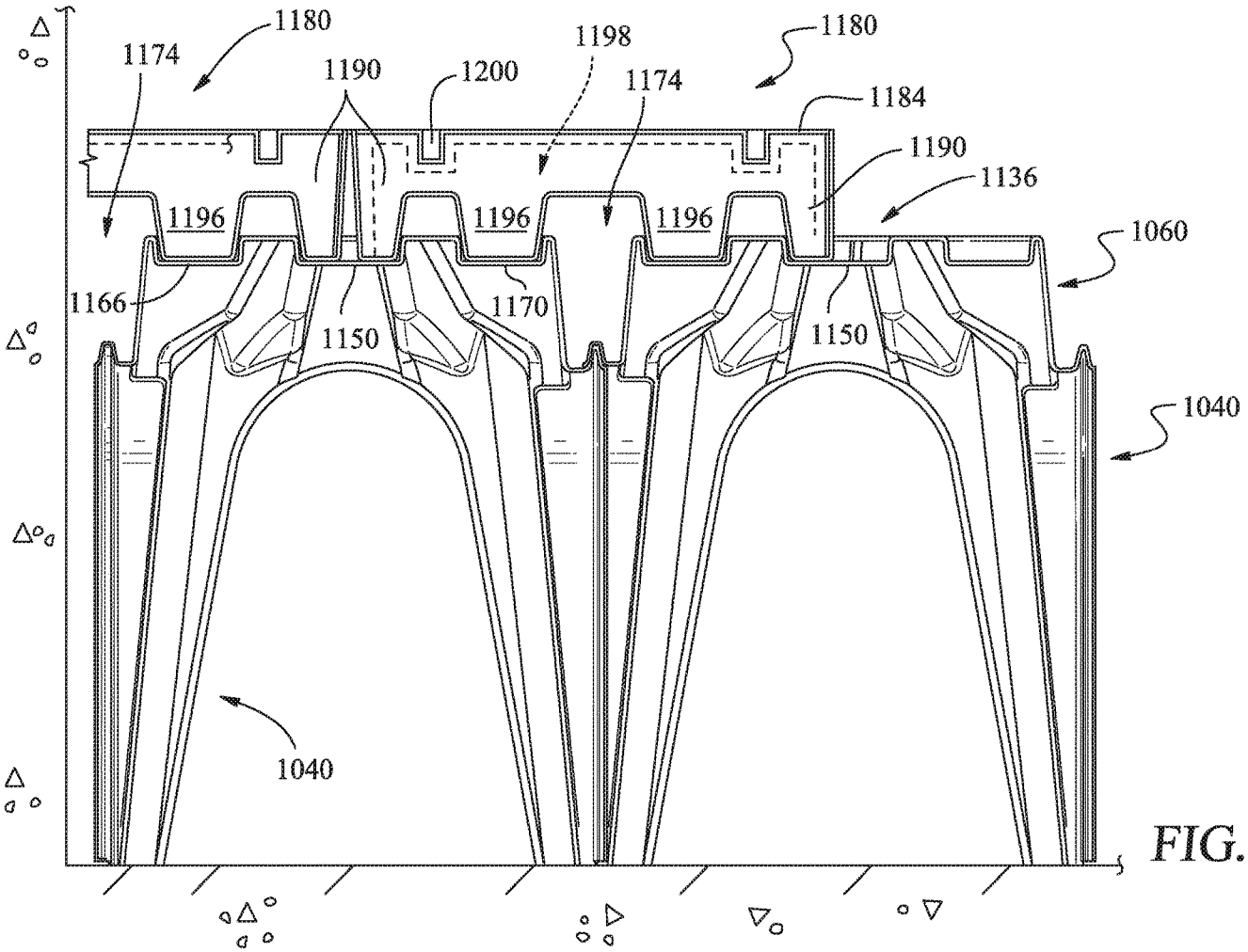
FIG. 23 is a partial cross-sectional view taken along line 23-23 in FIG. 17.

Exemplary unit 1040 support surface 1130 further includes four outer recesses 1160 positioned radially outward from longitudinal axis 1066 as best seen in FIG. 20. Outer recesses further have a support surface 1170 as best seen in FIGS. 21 and 23. Outer recesses 1160 are each defined by a formation 1166 as best seen in FIG. 18. It is understood that central 1136 and outer 1160 recesses may take different sizes, shapes, configurations, numbers and positions on unit 1040 to suit other requirements and performance specifications as known by those skilled in the art.

In a preferred example, modular retention units 1040 are vertically stackable in a nesting arrangement on top of one another. This stackability, when combined with the elimination, or substantial elimination, of backfill stone material, greatly decreases the footprint the system 1010 requires at the jobsite prior to installation. Referring to FIG. 22, on placement and connection of a desired number and configuration of retention units 1040, interstitial volume spaces 1174 are created between the exterior surfaces of each adjacent retention unit 1040. Interstitial volume spaces are further created between the outer rows of retention units 1040 and the wall 1024 or limits of the excavation as best seen in FIG. 22 (all referred to as interstitial volume spaces for convenience). In prior/conventional below ground level storm water retention devices, these interstitial volume spaces were typically required to be filed with porous material, typically crushed stone. Prior device's use of stone to fill in around the water management devices occupy an estimated 60-70% of the void space volume in these interstitial spaces or volumes not occupied by the prior stormwater management devices. The prior use of stone thereby reduced the void space available for stormwater retention by 60-70% in these interstitial void space areas.

Modular units 1040 may be made from the same materials as modular unit 100 described above and be of the approximate general size and proportions as unit 100 unless otherwise described herein. It is understood that modular unit 1040 can take different shapes, sizes, configurations and materials to suit the particular application and environment as well as the predetermined performance specifications as known by those skilled in the art. The relatively thin-walled, robust geometric design allows the units 1040 to be easily lifted, carried, manipulated and installed in the excavation 1016 by a single human person for easy installation.

Referring to FIGS. 16, 17, 23 and 24, in the exemplary modular system 1010, one or more modular trays or cover plates 1180 (two shown) are used atop of the interconnected, modular units 1040. Each exemplary tray 1180 includes a top surface 1184 having a peripheral edge and sides 1186 as generally shown. Preferably, each tray 1180 includes corner legs 1190 and inner legs 1196 adjacent each side 1180 as generally shown.

Figure 24:
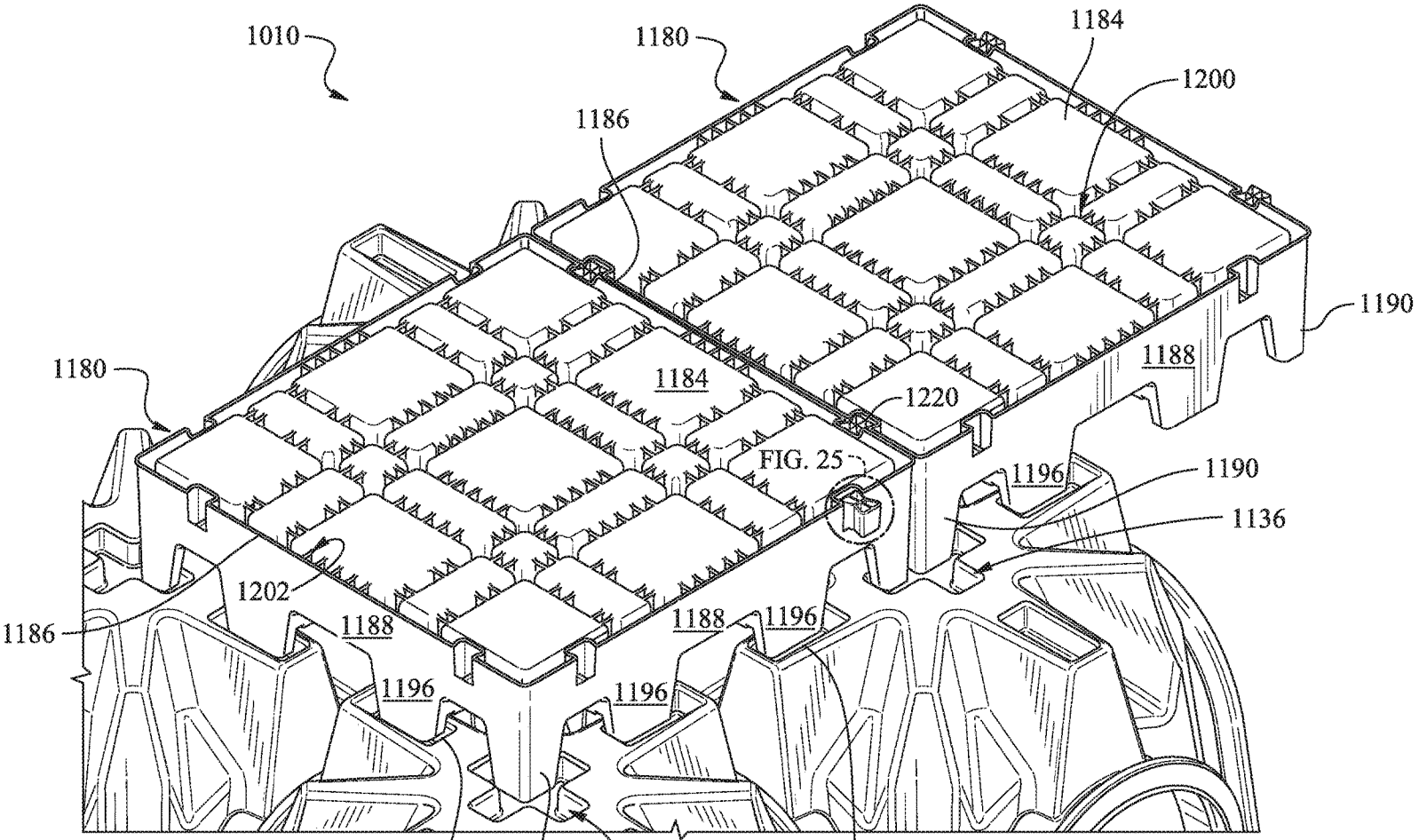
FIG. 24 is an alternate partial schematic perspective view of an example of an alternate storm water management system.

In a preferred example of system 1010, each tray 1180 is sized and oriented to span between at least two adjacent units 1040, and most preferably four retention units as shown, such that the tray corner legs 1190 are positioned in a respective central recess of adjacent units 1040 as best seen in FIGS. 17, 23 and 24. In this position, each tray 1180's inner legs are respectively positioned in an outer recess 1160 of adjacent units 1040 as generally shown. The bottom portions of the legs rest on and are supported by the respective support surfaces 1150 and 1166 as best seen in FIG. 23. It is understood that different configurations of the tray legs and recesses 1136 and 1160 may be used to engage and support the trays on the units 1040. For example, the recesses may be in the trays 1180 and protrusions or pins extending upward from the retention unit support surface 1130. Other connective mechanisms and configurations known by those skilled in the art may be used. It is further understood that other engagement devices and processes may be used to engage or connect the trays 1180 to the respective retention units 1040, for example mechanical fasteners, interference fits or integrally formed coordinating locking features, and other devices and processes known by those skilled in the art.

In a preferred example of trays 1180, adjacent tray peripheral edges 1186 and/or sides 1188 are in abutting contact with each other when the respective trays are engaged with the respective retention units 1040. In alternate examples, small gaps or clearances may exist between the edges 1186 or sides 1188 provided the gap is not large enough for back fill material to easily pass through into the interstitial areas 1174. The use of tray locks 206 aids in the management and control of such gaps. Other devices, for example spacers (not shown) could be used to close of block such gaps preventing backfill material from passing through the tray joints or gaps therebetween.

As best seen in FIGS. 23 and 24, in a preferred example, each tray 1180 is of thin walled construction having an open bottom between the corner and inner legs. Along with the underside of top surface 1184 define a tray internal cavity 1198 which also may serve as usable void space for the temporary storage and management of stormwater runoff in the event the excess runoff in the excavation 1016 exceeds the height of the modular units 1040.

Referring to FIGS. 17 and 24, in one preferred example of system 1010, sufficient numbers of retention units 1040 are used to substantially cover the surface area or footprint 1022 of the excavation 1016. In the preferred example, a plurality of trays 1180 are used and engaged with each of the retention units 1080. Referring to FIG. 22 on the outer rows of retention units adjacent the wall of the excavation 1024, the trays 1180 are preferably cut or trimmed so the edge of the facing tray is in close proximity to the wall to prevent back fill material from easily passing between the trimmed edge of the tray and the excavation wall 1024.

As best seen in FIG. 24, in a preferred example, each tray 1180 includes a plurality of channels 1200. These channels structures 1200 provide increased rigidity and also serve to channel water under the force of gravity from collecting in or on the trays 1180. Drainage through slits or holes may be positioned at the bottom of channels 1200 (not shown) to further direct and exit water seeping through the soil column or other materials positioned above the trays. Additional formations 1202 may be integrally molded or formed in the tray 1180 for strength and rigidity or to aid in the manufacture of the trays. Other channels, formations or geometric configurations, and in different numbers, shapes and sizes, for these tray features may be used to suit the particular specification and/or environment of installation as known by those skilled in the art.

In an alternate example not shown, use of a plurality of trays 1180 may be used as a support surface below the plurality of retention units 1040. For example, where the bottom of the excavation 1016 is unstable or not suitable for supporting the retention units 1040, a plurality of trays 1180 may be used as a floor or support surface for the retention units 1040 to rest on.

Trays 1180 are preferably square in shape to accommodate the geometric shape and recesses in units 1040 as described. Trays 1180 may be made from the same material as the modular units 100/1040 rendering them easy to lift, carry, manipulate and install by a human person. Other materials, sizes, shapes and configurations for trays 1180 may be used to suit the particular units 100/1040 or the application and performance specifications known by those skilled in the art. It is further understood that the trays 1180 may span and engage more or less retention units 1040, or not span between two and be singular with each retention unit, to suit the particular application and performance specification.

Figure 25:
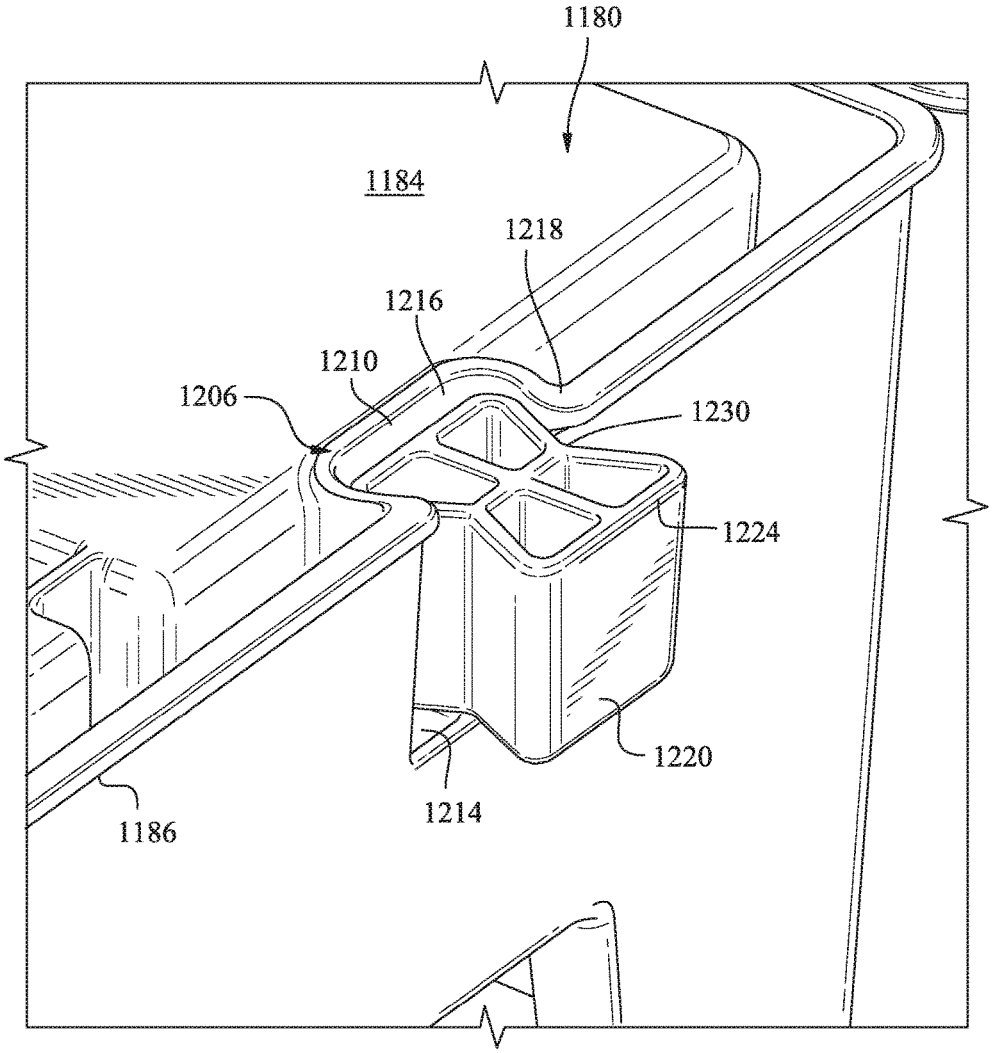
FIG. 25 is an enlarged partial perspective view in the area "A" in FIG. 24 showing an exemplary locking key.
Figure 26:
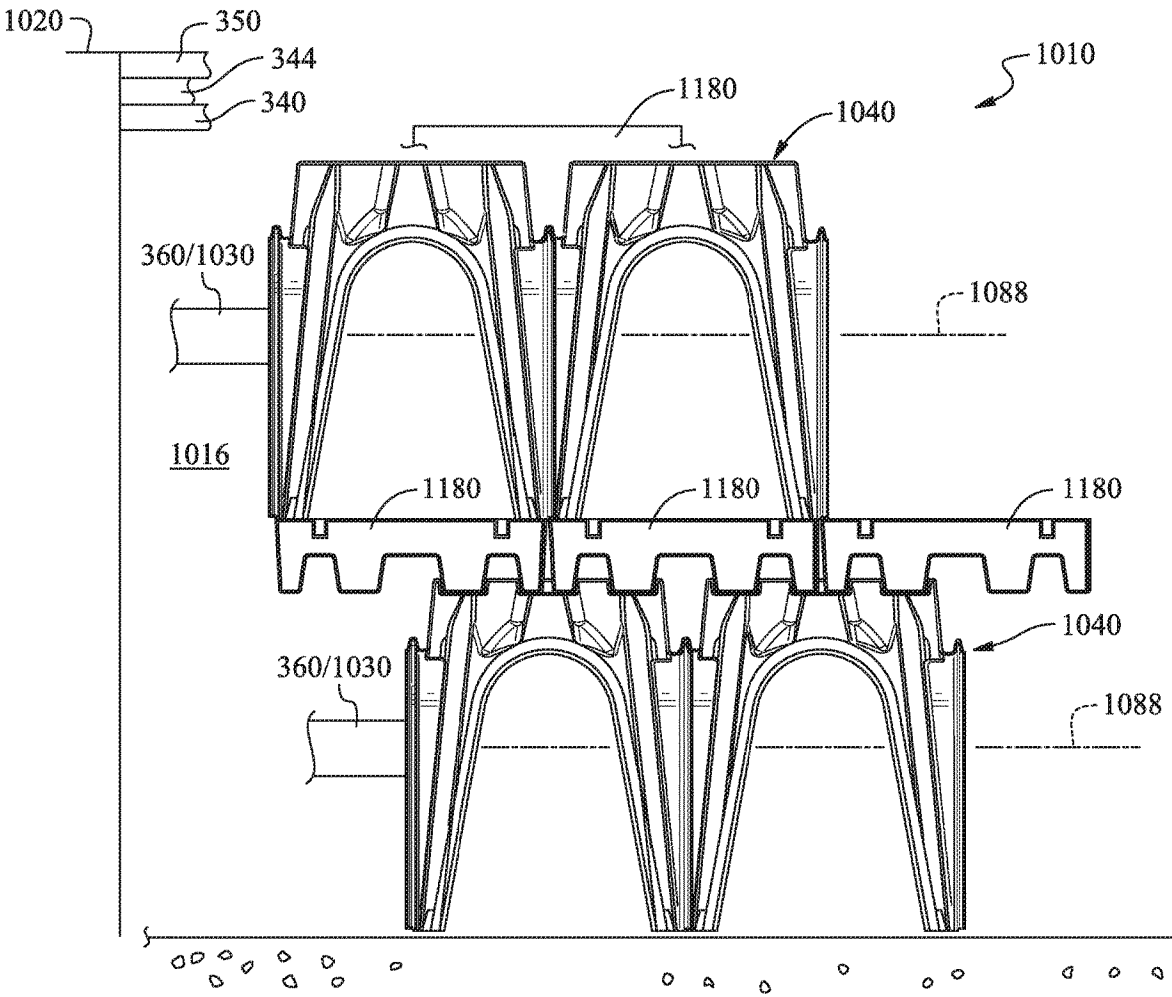
FIG. 26 is an elevational schematic view of an example of a two-level storm water management system using the exemplary modular units and trays.

Referring to FIGS. 24 and 25, exemplary tray locks 1206 including locking keys 1220 are shown to removably interconnect adjacent trays 1180 which provide further stabilization of the position and orientation of the plurality of modular units 1040 positioned beneath and engaged with the trays. In the example, each tray 1180 peripheral edge includes a locking slot 210 having a larger head portion 1216, a narrower neck portion and a support surface 1214 as best seen in FIG. 24.

In the example tray lock 1206, a locking key 1220 is used to interconnect the adjacent trays 1180 to one another. The exemplary keys include a wide portion 1224 and a narrow portion 1230. The wide 1224 and narrow 1230 portions are respectively sized and configured to fit inside of the respective head 1216 and neck 1218 portions of the locking slot 1210 as generally shown in FIG. 25. The keys 1220 are supported by the support surface 1214 as generally shown. In the preferred configuration, keys 1220 once installed provide resistance from the adjacent trays, and units 1040 in engagement therewith, from separating or rotating with respect to one another and yet capable of withstanding considerable weight from the materials 340, 344, 350, and other backfill materials, and loads placed on the pavement 350 from above. Locking keys 1220 may be made from the same materials as units 100/1040, other polymers, elastomers and/or composites, as well as ferrous and non-ferrous metals, may be used as known by those skilled in the art. Other devices and mechanisms to connect adjacent cover trays 1180 to one another, to units 1040 and/or stabilize adjacent trays and units 1040, for example mechanical fasteners, brackets, clips, gussets and adhesive, known by those skilled in the art may be used.

As best seen in FIGS. 23 and 24, once the desired units 1040 and trays 1180 are installed, the plates 1180 form a substantially continuous surface, or at least a surface which prevents substantial amounts of earth, gravel, small stones and other of the materials, including 340 and 344 from easily passing through the joints or small gaps between the peripheral sides 188 of adjacent trays 1180 to the interstitial volume spaces 1174 thereby filling void space 1018 which could otherwise be useful for collection and retention of additional storm water outside of the interior chamber 1106 provided by the retention units 1040.

A significant advantage of the structure, geometry, size, shape, orientation and connection of the modular retention units 1040 and trays 1180 is that porous materials, for example crushed stone, that prior systems required to be placed all around the water retention structures, and support the weight of the backfill material, are not needed, or are substantially reduced, with system 1010. The retention system 1010 is essentially self-standing/self-supporting which is made possible at least in part by the structure, configuration and connectivity by and between the modular units 1040 and the trays 1180.

The elimination or substantial reduction, of a porous material, for example stone, having to surround the water retention structures 1040/1180 include a significant increase in the available void space 1018 for the same volume of excavation 1016 over prior retention systems. In the present system 1010, the volume that prior stone surrounding the retention structures consumed can now be filled with additional storm water run-off or other retained fluids or materials. This increase of efficiency or available void space per unit volume of excavation may reduce the size of excavations needed which reduces the size and costs of the retention system needed. The elimination of a significant amount of porous material, typically crushed stone, is also significantly advantageous from a cost and labor standpoint as previously discussed.

Stone is expensive and laborious to purchase, transport to the excavation site 1016 and install around the water retention structure used in the excavation. Due to stone's density and hardness, heavy equipment is needed to transport, manage and install the stone at an installation site. Elimination or substantial reduction in the use of porous materials such as stone around the retention system has long been a difficulty and provided significant disadvantages noted above. Other advantages known by those skilled in the art are also observed.

The present system 1010 retention units 1040 and trays 1180 are sized and of construction to be manipulated, installed and connected by human hands requiring few, if any, power tools or heavy equipment. Once installed, the excavated or other backfill material can simply be installed on the trays 1180 to the desired level and grade for pavement 350 or other cover to be installed.

The modular retention system 1010 further provides significant improvement over the flexibility in the design of the retention systems, for example the shape of the system 1010 as described above. The particular configuration of the interconnected units may accommodate difficult or irregular jobsites, for example in FIG. 10. Referring to FIG. 25, an example of a two-tier or story retention system 1010 is shown. In the example, a second layer of interconnected retention units 1040 and cover plates 1180 are positioned on top of a lower layer or level of units 1010 and cover plates 1180 as generally shown. The materials 340, 344 and 350 may be used on top of the highest layer of units and cover plates. This capability provides even more flexibility where large run-off retention capacity is needed but only a small footprint area is available for excavation 1016.

In one example of the modular system 1010, closure panels 250 as described above and illustrated in FIGS. 7, 8, 10 and 11 may be used to cover or close selected of a modular unit's 1010 first 1110, second 1112, third 1114 and/or fourth 1116 openings so that water does not exit through that opening. Other closure mechanisms known by those skilled in the art may be used. Closure panels 250 may have other features, for example overflow ports (not shown) which may allow water to exit retention chamber 1106 due to, for example, water reaching a certain fill height inside the modular units or chamber. Bottom panels described above (not illustrated) may also be used to close or substantially close the portion of the unit 1040 between the lowest portion of the legs 1070. Other features for closure panels 250 known by those skilled in the art may be incorporated.

Figure 12:
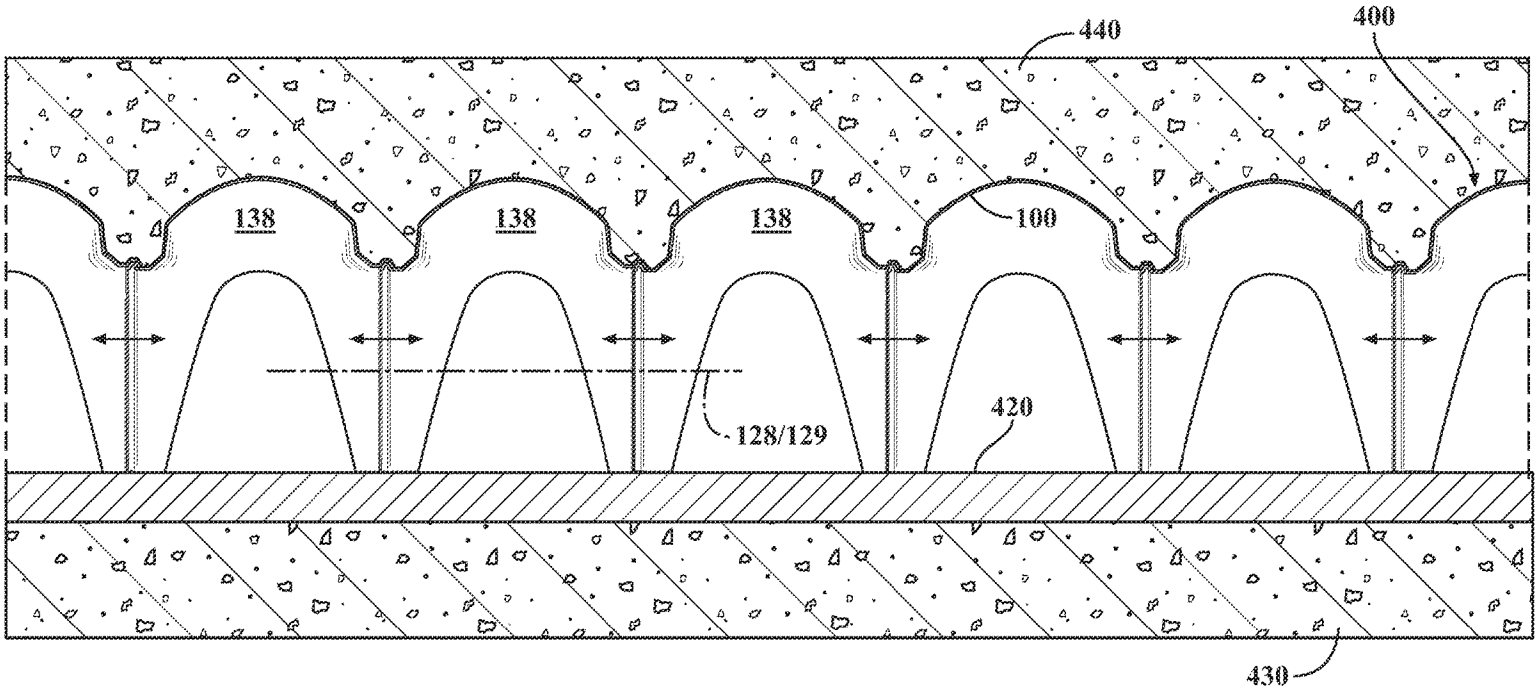
FIG. 12 is a cross-sectional schematic view showing an example of multiple conduit units encased in concrete and in an exemplary application for routing a utility line.

FIG. 12 is a schematic cross-section view showing an exemplary conduit structure 400 that may be utilized for routing a utility line 420. The exemplary conduit structure includes a plurality of conduit units 100 that are connected together to define an enclosed interior volume defined by hollow chambers 138 and a first through passage 146 (or 148). In the illustrated example suitable for multi-story commercial building floors, the conduit units 100 are encased in concrete 440. In an exemplary installation method, a first layer of concrete 430 can be poured and can at least partially cure. The vault structure 400 is then assembled through connection of a plurality of modular units 100 as described herein on top of the at least partially cured first lift or subfloor. A second layer of concrete 440 is then poured over and around the conduit structure 400 to permanently encase it while substantially or completely preventing the concrete from entering the hollow interior chambers 138 thereby providing one or more through passages 146/148 which the utility line 420 can be routed. Depending on the application and size of the units, the through passages may further provide a crawl space to service lines, cables or other structures routed which are not easily removed. It is understood that materials other than concrete may be used to surround or encase the conduit units depending on the application and performance specifications.

Figure 13:
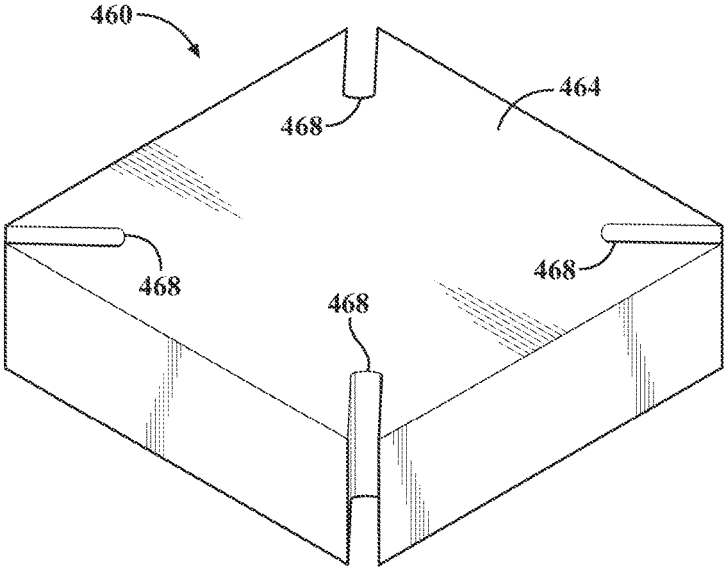
FIG. 13 is a perspective view showing an exemplary connecting conduit member.

Referring to FIG. 13, an example of a conduit unit base connector 460 is shown. In the example, base connector 460 includes a body 464 defining four slots 468 as generally shown. In the preferred example, base connector 460 is square, the slots 468 are formed at the corners and extend through a thickness of the body.

Figure 14:
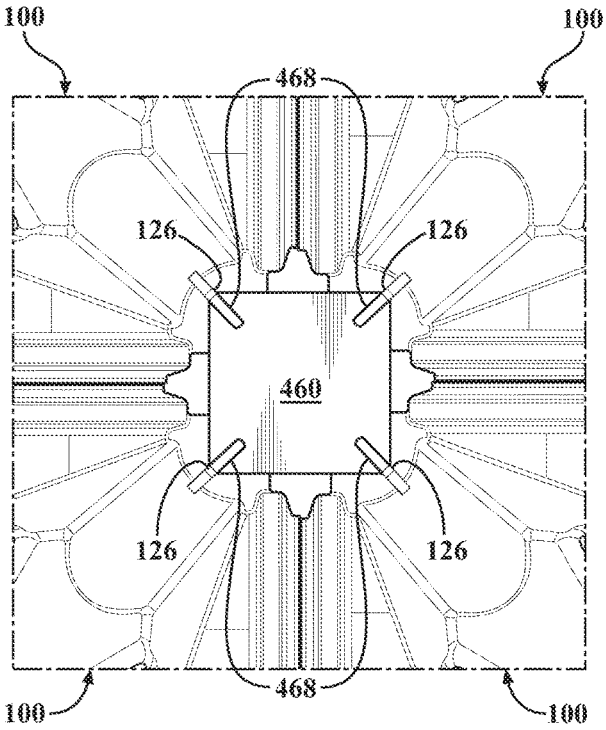
FIG. 14 is a top view showing four exemplary conduit units interconnected by the exemplary FIG. 13 connecting member.

As best seen in FIG. 14, an example of use of a base connector 460 is shown to assist in orienting and connecting four adjacent conduit units 100 together. In the example, a base connector may be installed between the adjacent legs 120 of the four units so that the upstanding plate member 126 atop of the foot pads 124 engages a respective slot 468 for each leg 120. In a preferred example, the frictional engagement between base connector 460 and the plate members 126 will be sufficient to provide the required additional stability and orientation of the adjacent conduit units during an installation process, for example, installation of backfill material around the unit structure as generally described herein. It is understood that other structures and engagements with conduit units 100 to provide increased stability or orientation may be used as known by those skilled in the art.

Figure 15:
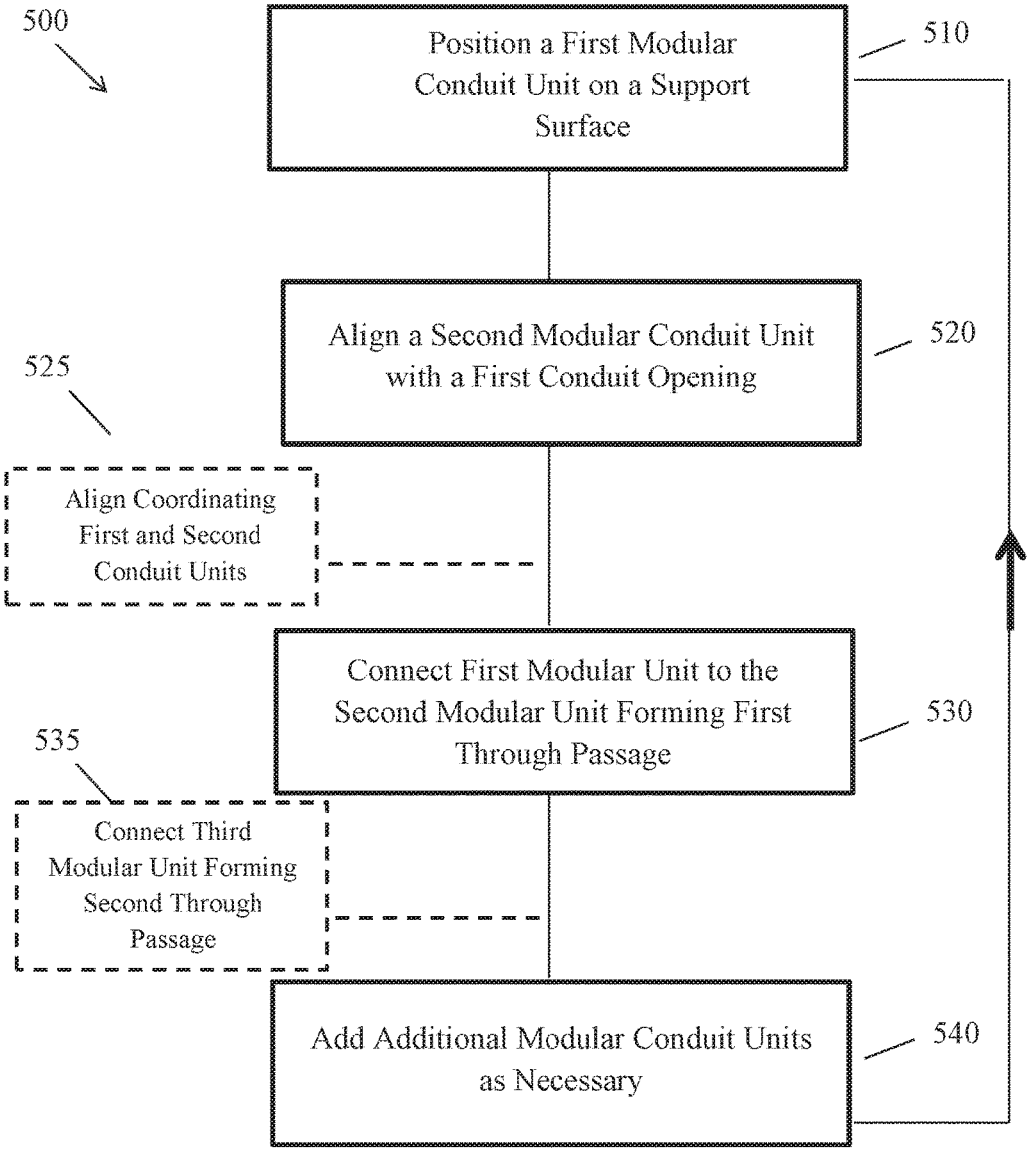
FIG. 15 is a schematic flow chart of an example of a method of constructing a modular conduit unit structure.

Referring to FIG. 15, an exemplary process to form a modular conduit unit 500 is illustrated. In an exemplary step 510, a first modular conduit unit 200 having four sides 101-104, four respective openings 141-144 along respective axes 128 and 129 and an interior hollow chamber 128 is placed on a support surface. The support surface may be a hard permanent surface such as concrete, a porous or other material as described herein.

In exemplary step 520, a second modular conduit unit 210 having the same or substantially the same structure as first conduit unit 200 is oriented along one of the respective axis 128 or 129 to align one of a respective opening 141-144 with a respective one opening 141-144 of the first modular conduit unit.

In an optional step 525, a first connector portion or a second connector portion on the first conduit unit 200 is aligned with a coordinating second connector portion or first connector portion of the second conduit unit 210.

In step 530, the first 200 and the second 210 conduit units are connected together defining a first through passage 146 along first chamber axis 128 (or second through passage 148 along axis 129).

In an alternate step 535, a third 290 modular conduit unit is connected to the first 200 (or second 210) modular unit defining a second through passage 148 along second chamber axis 129 (or first through passage 148 along axis 128).

In exemplary step 540, the method steps of connecting additional modular conduit units 100 are repeated along one or both of the first 128 and second 129 chamber axes to define additional first 146 and second 148 passageways for the desired application or spatial environment at the work site.

In alternate method step not illustrated, one or more closure panels 250 are selectively connected to a respective conduit unit opening 141-144 on one or more first 200 and second 210 conduit units to close or terminate the opening or first 146 and/or second 148 passageways.

In an alternate step not shown, one or more utility lines or cables are routed through one or both of the first 146 and second 148 through passages defined by the plurality of connected modular conduit units 100 and or 200, 201.

In an alternate method step not illustrated, once the designed number of modular conduit units are connected and installed on the support surface in the designed location and configuration, material is deposited around and on top of the connected modular conduit units to encase at least a portion of the connected conduit structure. In an alternate step of installing closure panels 250 not shown, closure panels 250 are installed on all, or substantially all, exterior facing openings 141-144 of the structure to form a fluid retaining reservoir or enclosure, for example storm water retention and management.

In an alternate method step not shown, the connected desired number and configuration of first 200 and second 210 modular conduit units are encased in concrete in a respective floor or wall of a single or multi-story commercial building.

Figure 27:
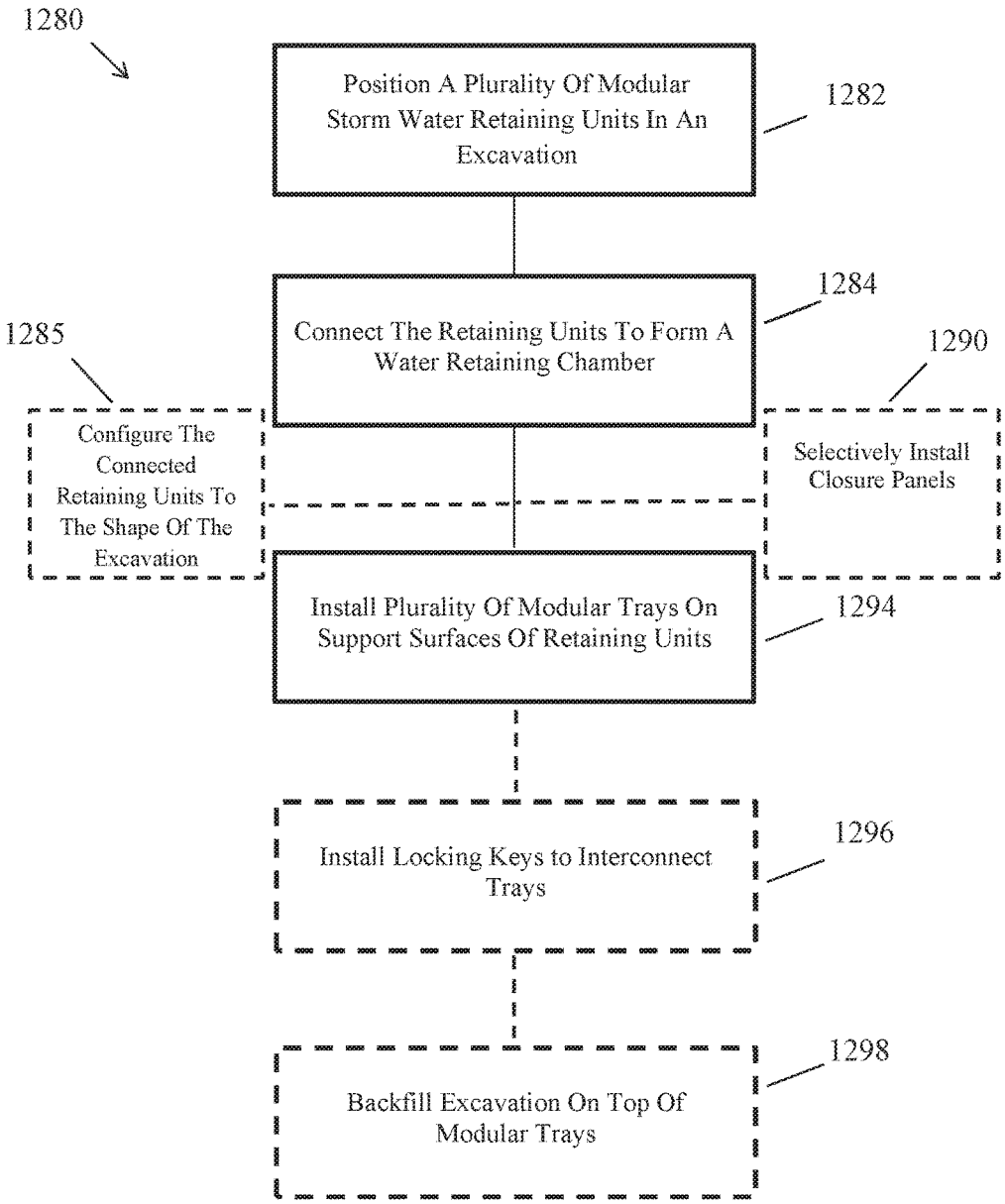
FIG. 27 is a schematic flow chart of an example of a process for constructing an underground level storm water retaining system.

Referring to FIG. 27, an example of a process for constructing and using a modular storm water retention system 1280 is illustrated. In the exemplary process, the steps of using modular retention units for a below ground level storm water retention system in FIG. 15 steps 510, 520, 530, 540 and optional steps 525 and 535 described above may be used for the alternate modular water retention management device described above and illustrated in FIGS. 16-26 and are not repeated.

Referring to FIG. 27, in step 1282 a plurality of modular retention units are positioned in preferably a below ground surface excavation defining a void space. In exemplary step 1284, the plurality of individual, modular retention units 1040 are connected to one another in the matter described above for FIG. 15 and elsewhere herein. In an optional step 1285, the number, placement and connection of the individual modular units 1040 are made in such a way as to conform to the shape and orientation of the excavation. Due to the modular retention units and structures, for example the preferred, first 1110, second 1112, third 1114 and fourth 1116 openings, the system 1010 is particularly flexible to accommodate irregular excavation spaces and areas over prior devices. See for example FIG. 10.

In optional step 1290, closure panels 250 may be selectively installed to close one or more of the exterior facing side openings, or other selected sides, of the modular units to provide containment of water, or other materials or substances, desired to be collected and retained within the collective retention chamber 1106 formed by the individual chambers of the respective modular units 1040.

Still referring to FIG. 27, exemplary step 1294 includes installing one or more, and preferably a plurality of modular trays 1180, preferably atop and spanning adjacent modular retention units 1040 as described above and illustrated in FIGS. 23 and 24. Where large retention structures 1010 are constructed, a plurality of trays 1180 would be employed to substantially cover the area footprint by the plurality of modular units 1040 as described and illustrated. As best seen in FIG. 23, the trays 1180 may extend beyond the retention unit top portion to further cover areas and void space below the trays on the exterior our outward rows of retention units to the walls of the excavation. In one method step not shown, trays 1180 may be cut or trimmed as necessary so that the trays extend to the walls or limits of the excavation to maximize coverage of the trays so backfill material does not fall below the trays 1180 and into the excavation void space or interstitial volume spaces 1174 between the connected retention units 1040.

In exemplary optional step 1296 one or more locking keys 1220 are installed in locking slots 1210 to interconnect adjacent trays 1180 to secure and/or further stabilize and prevent relative movement of the modular units 1040 and trays 1180 relative to one another and the excavation 1016.

In an exemplary step not shown, the constructed configuration of modular units 1040 and trays 1180 are connected in fluid connectivity to a down pipe 1030 or other drain structure of a storm water drain so that storm water run-off collected by the drain 1026 is transferred by gravity into the retention device 1010 for retention and gradual disbursal and absorption into the surrounding environment. Use of a header retention structure (not illustrated) which may be made from units 1040 and trays 1180 may be positioned between the down pipe 1030 and main retention structure 1010 as known by those skilled in the art. Additional pipes, not shown, would fluidly connect the header row to the main retention structure 1010. The pipes extending from the header row may include pipe inlet elbow devices, dual pipe configurations for overflow and debris management, as well as sediment management devices disclosed in U.S. Patent Publication No. US2013/0008841A1 owned by the present applicant and incorporated herein by reference.

In an exemplary optional step 198, the materials, generally referred to as backfill materials herein, which for example may include 344 and/or earth or other materials, are installed atop of the cover plates 1180 to backfill the excavation back to ground level 1020 or other desired height, for example so that paving can be installed on top of the backfilled excavation 1016. In a preferred example, little or no backfill materials 330 or 344 are installed or backfilled in or around the constructed system 1010 below the trays 1180. For example, in the preferred apparatus and method, the trays prevent, or substantially prevent, large amounts of porous or backfill material from passing below or through the trays 1180 down to the bottom of the excavation or into the interstitial volume spaces 1174 between the connected retention units 1040 or the retention units and the excavation walls 1024.

This highly advantageous structure 1010 and method 1080 greatly reduces, or eliminates, the need for porous material from having to be installed around and in between the storm water retention structure required by prior devices. This apparatus and process further leaves the interstitial space/volumes 1174 between the retention units and between the retention units and the excavation wall 1024 available as void space for additional water outside of the interior chamber volume 1106 to collect to maximize the void space of the retention system 1010 in excavation 1016.

The structure and design of the modular retention units 1040 and trays 1180 described for device 1010 and process 1280 produce a system that is self-standing, self-supporting, does not require, or requires a significantly less, porous material such as stone in the void space compared with prior/conventional underground retention systems. The exemplary apparatus 1010 and process 1280 is capable of supporting common backfill materials and paving 340, 344 and 350 installed atop of the trays 1180 to fill and pave over the excavation while remaining a fully functional storm water run-off collection and retention system having high performance and long life compared to prior devices and processes.

While the description herein is made with respect to specific implementations, it is to be understood that the invention is not to be limited to the disclosed implementations but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A modular storm water retention system for use in constructing an underground storm water retention structure, the storm water retention system comprising:

a plurality of modular fluid retention units, each retention unit comprising:

a bottom portion defining at least a first and a second opening;

a top portion connected to the bottom portion, the top portion having a support surface, the top and bottom portions defining an interior water retention chamber volume beneath the top portion in communication with the first and the second openings defining a first through passage between the first and the second opening;

a connector adapted to selectively connect the plurality of modular retention units to extend the first through passage passageway between connected retention units and increase the interior chamber volume; and a modular tray positioned above the retention unit top portion and selectively engageable with the top portion support surface, the tray having peripheral sides.

2. The retention system of claim 1 wherein the modular tray further comprises:

a plurality of modular trays positioned adjacent to one another having one peripheral side in close proximity to an adjacent tray peripheral side, the trays substantially covering interstitial volume spaces between retention units below the trays preventing backfill material from entering the interstitial volume spaces.

3. The retention system of claim 2 wherein the retention unit support surface is substantially horizontal.

4. The retention system of claim 3 wherein each of the plurality of trays further comprises:

a modular key slot defined by each modular tray peripheral side; and a plurality of locking keys selectively positionable in a respective key slot in adjacent trays to selectively connect adjacent trays.

5. The retention system of claim 3 wherein each tray extends between four adjacent retention units and is supported by the respective retention unit support surface.

6. The retention system of claim 3 wherein the each modular retention unit horizontal support surface defines a plurality of recesses, each of the plurality of recesses having a lower support surface.

7. The retention system of claim 6 wherein each modular tray further comprises a top surface and a plurality of legs extending below the top surface, each of the plurality of tray legs abuttingly engaging one of the plurality of retention unit lower support surfaces through the respective recesses thereby preventing relative movement of the engaged retention units with respect to one another.

8. The retention system of claim 7 wherein the plurality of tray legs further comprises corner legs each extending from a corner of the tray and inner legs extending from the peripheral sides between the corner legs.

9. The retention system of claim 8 wherein the plurality of recesses in each modular retention unit further comprises:

a central recess having a first channel and a second channel transverse to the first channel; and four outer recesses positioned radially outward from the central recess and equally angularly positioned from one another, the respective tray corner legs positioned in the respective center recesses of adjacent retention units and the tray inner legs positioned in the respective outer recesses of adjacent retention units to automatically orient and align the trays with respect to the retention unit and adjacent trays.

10. The retention system of claim 2 wherein:

each retention unit bottom portion comprises four legs defining a first, a second, a third and a fourth side orthogonally positioned with respect to one another; and the first and a second openings further comprises a third and a fourth opening, each of the first, the second, the third and the fourth openings defined by a respective one of the first, the second, the third and the fourth side, two of the first, the second, the third and the fourth openings positioned along a first chamber axis defining the first through passageway and the other two of the first, the second, the third and the fourth openings positioned along a second chamber axis defining a second through passageway.

11. The retention system of claim 10 wherein each of the first, the second, the third and the fourth sides comprise an arch defining the respective first, the second, the third and the fourth openings, the connector integral to each of the arches.

12. A self-supporting modular storm water retention system for use in an underground earthen excavation defining a void space volume, the modular storm water retention system comprising:

a plurality of selectively connectable modular water retention units, each retention unit comprising:

a bottom portion having a plurality of legs defining a first, a second, a third and a fourth side positioned orthogonally to each other, each side defining a respective first, second, third and fourth opening;

a top portion connected to the bottom portion, the top portion having a substantially horizontal support surface, the top and bottom portions defining an interior fluid retention chamber volume beneath the top portion in communication with the first, the second, the third and the fourth openings defining a first through passage between the first and the second opening and a second through passage between the third and the fourth openings;

a connector adapted to selectively connect the plurality of modular retention units to extend the fluid retention chamber to connected of the plurality of retention units, the connected modular retention units defining interstitial volume spaces between connected retention units and between retention units and a wall of the excavation;

a plurality of closure panels selectively connected to the retention unit first, the second, the third, and the fourth openings to close the retention chamber volume; and a plurality of modular trays positioned above the plurality of retention unit top portions, each tray comprising:

a top surface extending between two connected retention units substantially covering the interstitial volume spaces;

a plurality of tray legs engageable with the retention unit substantially horizontal support surface of each respective of the two connected retention units, wherein the plurality of trays prevent relative movement of the engaged retention units and prevent backfill material from entering the interstitial volume spaces thereby increasing the availability of the void space volume for the collection and retention of water.

13. The retention system of claim 12 wherein the plurality of tray legs further comprises corner legs each extending from a corner of the respective tray and inner legs extending from the respective peripheral sides between the corner legs; and each modular tray further comprises:

the support surface defining a central recess having a first channel and a second channel transverse to the first channel; and the support surface defining four outer recesses positioned radially outward from the central recess and equally angularly positioned from one another, each of the central recess and the outer recesses having a lower support surface, the respective tray corner legs positioned in the respective center recesses of adjacent retention units in engagement with the lower support surface and the tray inner legs positioned in the respective outer recesses of adjacent retention units in engagement with the lower support surface to automatically orient and align the trays with respect to the retention unit and adjacent trays.

14. The retention system of claim 12 wherein each of the plurality of trays further comprises:

a modular key slot defined by each tray peripheral side; and a plurality of locking keys selectively positionable in a respective key slot in adjacent trays to selectively connect adjacent trays thereby preventing relative movement of the trays and relative movement of the engaged retention units.

15. A method of constructing a storm water retention system for use in a below ground level excavation defining a void space volume, the method comprising the steps of:

positioning a plurality of independent modular fluid retaining units having a support surface in an excavation void space volume;

selectively connecting the plurality of retaining units in the void space volume defining an interior fluid chamber volume, the connected retaining units defining interstitial volume spaces between the connected retaining units within the void space; and engaging a plurality of modular trays to the respective support surfaces of the plurality of retaining units, the trays supporting backfill material on a top surface of the trays without allowing substantial backfill material to enter the interstitial volume spaces.

16. The method of claim 15 wherein the step of engaging a plurality of trays further comprises the steps of:

positioning each tray to engage four adjacent connected retention units to cover one of the interstitial volume spaces between the four connected retention units thereby preventing the backfill material from entering the interstitial volume space and preventing relative movement of the four engaged retention units.

17. The method of claim 15 further comprising the step of interconnecting the trays positioned adjacent to one another preventing relative movement of the interconnected trays.

18. The method of claim 15 further comprising the step of selectively connecting closure panels to openings defined by the retention units to enclose the interior fluid chamber volume.

* * * * *